US005868387A

United States Patent [19]

Kida et al.

[11] Patent Number: 5,868,387

[45] Date of Patent: Feb. 9, 1999

[54] SHEET DISCHARGE PROCESSING DEVICE

[75] Inventors: Hiroshi Kida, Yamatokoriyama; Norio Hontani; Masanori Kato, both of Hiroshima; Masanori Takeda, Fukuyama; Kiyohide Ochi, Hiroshima, all of Japan

[73] Assignee: Sharp Kabushiki Kaisha, Osaka, Japan

[21] Appl. No.: 719,212

[22] Filed: Sep. 25, 1996

[30] Foreign Application Priority Data

Sep. 26, 1995 [JP] Japan ..... 7-247812

[51] Int. Cl.[6] ..... B65H 39/10

[52] U.S. Cl. ..... 271/304; 271/186; 271/209

[58] Field of Search ..... 399/364, 406; 271/288, 291, 298, 303, 304, 186, 902, 209, 265.02, 265.03

[56] References Cited

U.S. PATENT DOCUMENTS 4,871,163 10/1989 Landa et al. ..... 271/298
4,925,178 5/1990 Clabbers et al. ..... 271/291

FOREIGN PATENT DOCUMENTS 60-19638 1/1985 Japan ..... 271/291
60-52458 3/1985 Japan .
63-295325 12/1988 Japan ..... 271/209
2-81857 3/1990 Japan ..... 271/298
5310357 11/1993 Japan .

*Primary Examiner*—H. Grant Skaggs

[57] ABSTRACT

First and second switchback convey paths are arranged to be symmetrical about the convey path between an inlet and a discharge path. First and second detection sensors are arranged on the first and second switchback convey paths, respectively, to detect sheets conveyed therein. A switching gate is rotatably placed between the respective convey paths. The switching gate is constituted by a first reverse guide path for causing the inlet to communicate with the first switchback convey path and also causing the discharge path to communicate with the first switchback convey path, and a second reverse guide path for causing the discharge path to communicate with the second switchback convey path and also causing the inlet to communicate with the second switchback convey path. The switching gate is switched in a state wherein the trailing end of a conveyed sheet is detected by the first detection sensor on the first switchback convey path, but no sheet is detected by the second detection sensor on the second switchback convey path. With this operation, switching control can be accurately performed without leaving the trailing end of a sheet in any of the guide paths of the switching gate.

13 Claims, 22 Drawing Sheets

SHEET DISCHARGE PROCESSING DEVICE

BACKGROUND OF THE INVENTION (1) Field of the Invention

The present invention relates to a sheet discharge processing device for performing discharge processing upon determining in accordance with an instruction whether to discharge a sheet on which an image is formed by an image forming apparatus with the image-bearing surface facing down or up.

(2) Description of the Prior Art

Recently, a digital copying machine has been commercialized as a multi-function machine which operates in the printer mode, the facsimile mode, and the like as well as in the copy mode. In the general copy mode, sheets of paper are sequentially discharged facing up, i.e., with the image-bearing surface facing up. In the printer mode, face-down paper discharge, i.e., paper discharge with each image-bearing surface facing down, is generally performed. More specifically, in the general copy mode, in consideration of the collation of image-formed sheets to be discharged, an automatic document feeder or the like is used to feed originals so as to cause the machine to sequentially form images on sheets from the last page, thereby discharging image-formed sheets in the collated or sorted state. In contrast to this, when the machine operates as a printer, since image data is sequentially transferred from an external device from the first page, image formation is performed from the first page. For this reason, sheets must be discharged without changing their postures or discharged after being reversed.

In order to realize this sheet discharge processing function, for example, Japanese Patent Application Laid-open Hei 5 No. 310357 discloses a device having that function. The arrangement of this device will be briefly described below. As shown in FIG. 21, when a toner image on a photoreceptor 101 is transferred onto a sheet fed from a paper feed tray 100, the sheet passes through a fixing device 102 and is discharged out of the device. A paper discharge processing unit 103 switches the sheet discharge modes in accordance with the copy mode or the printer mode.

When the image forming apparatus is in the copy mode, the sheet is discharged, with the recording surface facing up, onto a first discharge tray 105 through a paper outlet 104 via various convey rollers of a paper discharge processing unit 103. In the printer mode, the convey path is switched to temporarily guide the sheet to a switchback convey path 106 via various convey rollers, and the convey direction is switched by a switching means 107. Thereafter, the sheet is discharged, with the recording surface facing down, onto a second discharge tray 109 through a paper outlet 108.

Referring to FIG. 21, reference numeral 110 denotes an intermediate unit for double-sided image formation which is detachably or integrally mounted on a digital image forming apparatus body 111. When the intermediate unit 110 is mounted on the image forming apparatus body 111, in forming images on the upper and lower surfaces of a sheet, the sheet is conveyed into an intermediate tray 112 via the paper discharge processing unit 103 and the switchback convey path 106, and is conveyed again from the intermediate tray 112 to the transfer position on the photoreceptor 101 on which a toner image is formed.

In order to form images, a laser beam irradiation unit 113 is placed above the photoreceptor 101, and a read unit (scanner) 114 for optically reading an image on an original is placed in the uppermost portion of the apparatus. An image on an original placed on a transparent original table 115 is formed on a CCD 117 as a read element by the scanner 114 through an optical system 116. The image is photoelectrically converted and read by the CCD 117. The semiconductor laser of the laser beam irradiation unit 113 is driven on the basis of the read image data to form an image on the photoreceptor 101.

In discharging sheets on which image are formed by the above arrangement, because of the use of the switchback convey path 106, the sheet convey cycle must be set to a value larger than the length of each sheet in the convey direction so as to prevent the leading and trailing ends of sheets from overlapping. As the image formation speed increases, the convey speed of the switchback convey path 106 needs to be higher than the convey speed in an image formation process. If, however, the convey speed increases, jams and the like may occur frequently.

In order to eliminate such a drawback in the device disclosed in Japanese Patent Application Laid-open Hei 5 No.310357, the device disclosed in Japanese Patent Application Laid-open Sho 60 No.52458 alternately uses two switchback paths to shorten the sheet convey cycle. In this device, as shown in FIG. 22A, a reverse convey device 120 is placed midway along the path extending from an inlet 121 to which a sheet having undergone an image formation process in the image forming apparatus is conveyed to an outlet 122 through which the sheet is discharged. Convey rollers 123 are arranged at the inlet 121, and the fed state of a sheet is detected by a paper feed detection switch 124. Discharge rollers 125 are arranged at the outlet 122.

A switching gate 128 is rotatably placed between the inlet 121 and the outlet 122. The switching gate 128 guides a sheet P to linear switchback paths 126 and 127 extending in the vertical direction. The switching gate 128 has a first guide surface 128*a* for guiding a sheet to the upper or lower switchback path 126 or 127, a second guide surface 128*b* for guiding the sheet from the upper or lower switchback path 126 or 127 to the outlet 122, and a straight guide path 128*c* for causing the sheet to travel straight from the inlet 121 to the outlet 122 without reversing it.

In the above arrangement, when a sheet P having undergone image formation in the image forming apparatus is conveyed to the inlet 121, the sheet P is clamped between the convey rollers 123 to be continuously conveyed. When the leading end of the sheet P is detected by the paper feed detection switch 124, the switching gate 128 is switched first to the state shown in FIG. 22A to guide the sheet P to the upper switchback path 126. After the paper feed detection switch 124 detects that the sheet P is reliably conveyed into the switchback path 126, i.e., after the paper feed detection switch 124 detects the trailing end of the sheet P, and the trailing end of the sheet P is clamped between convey rollers 126*a* arranged at the switchback path 126, the switching gate 128 is switched to the position in FIG. 22B.

After this operation, the rotating directions of the convey rollers 126*a* are reversed to guide the sheet P to the discharge rollers 125 at the outlet 122 along the first guide surface 128*a*. At the same time, the next sheet P having undergone image formation is guided to the second switchback path 127 along the second guide surface 128*b* of the switching gate 128. At the timing when the trailing end of the sheet P is detected by the paper feed detection switch 124, and the sheet P is clamped between convey rollers 127*a* at the lower switchback path 127, it is assumed that the sheet P in the switchback path 126 is completely discharged, and the switching gate 128 is rotated through 90° (in the counter-clockwise direction).

As described above, after sheets P on which images are formed are conveyed into the upper and lower switchback paths 126 and 127, the sheets P are alternately discharged to the outlet 122. For this reason, even if one sheet P is conveyed into the reverse convey path at the same time another sheet P is conveyed from the reverse convey path to the outlet, the leading and trailing ends of the sheets P dot not overlap, and the sheets P can be reversed/discharged in a shorter cycle.

As described above, with the use of the sheet discharge processing device disclosed in Japanese Patent Application Laid-open Sho 60 No.52458, sheets P can be discharged in a shorter convey cycle. Even if, therefore, the processing speed of an image formation apparatus increases, appropriate discharge processing can be performed.

In the arrangement having two switchback paths, the guide surfaces are arranged to guide the sheet P to the switchback path and also guide the sheet P from the switchback path to the outlet. This arrangement also includes guide plates 129*a* to 129*d* and the like in FIG. 22 opposing these guide surfaces to reliably guide the sheet P. However, when the switching gate 128 is to be rotated about a rotating shaft, these guide plates 129 and the like must be retracted. Without the guide plates 129, the switching gate 128 can be rotated without being interfered, and hence the rotation mechanism can be simplified. However, the sheet P is guided unstably, so that a convey failure or a jam of the sheet P may occur frequently when the sheet P is conveyed into the switchback paths 126 and 127 or guided from the switchback paths 126 and 127 to the discharge rollers 125. The sheet P tends to curl in one direction because it passes through the fixing rollers in the process of image formation. For this reason, the sheet P cannot be reliably guided with only the guide surfaces 128*a* and 128*b* of the switching gate 128.

In addition, since the switchback paths are formed in a line, a very large wasteful space is required in the vertical direction. Since each switchback path requires a linear distance long enough to store a sheet of the maximum size, a space exceeding twice the maximum size is required. Consequently, the sheet discharge processing device has a large size, and a large wasteful space is formed.

Furthermore, according to the above description, sheets are alternately discharged. In this technique, however, if a sheet jam occurs in the image forming apparatus body, or the image formation cycle becomes unstable, the switching timing of the switching gate greatly shifts, and switching is performed while a sheet is discharged. As a result, the sheet, the switching gage, or the like may be damaged.

SUMMARY OF THE INVENTION

It is an object of the present invention to provide a sheet discharge processing device which can convey a sheet into a switchback convey path and discharge a sheet from another switchback convey path at the same time, and can reliably guide a sheet into each switchback convey path and can also reliably guide a sheet to be discharged from each convey path.

It is another object of the present invention to provide a sheet discharge processing device which requires no extra space for a reverse convey device, and allows a reduction in size.

It is still another object of the present invention to provide a sheet discharge processing device which can reliably perform sheet discharge control in upper and lower convey paths when a conveyed sheet jams.

According to an aspect of the present invention, there is provided a sheet discharge processing device for sequentially discharging sheets, sent through image forming means for forming images on the sheets on the basis of image data, onto a discharge tray with image-bearing surfaces of the sheets facing up or down, which comprises: first and second switchback convey paths being vertically arranged between an inlet path into which a sheet conveyed through the image forming means is conveyed and a discharge path for discharging a sheet onto the discharge tray, and the first and second switchback convey paths being adapted to reverse the front and back of sheets; a switching gate including a first reverse guide path for causing the first switchback convey path to communicate with the discharge path when the second switchback convey path communicates with the inlet path, a second reverse guide path for causing the second switchback convey path to communicate with the discharge path when the first switchback convey path communicates with the inlet path, and a straight guide path for causing the inlet path to communicate with the discharge path, and the switching gate being rotatably placed between the inlet path and the discharge path; and control means for controlling a rotation position of the switching gate such that a sheet conveyed through the image forming means is discharged onto the discharge tray through the inlet path, the first switchback convey path, the second switchback convey path, or directly the discharge path, wherein the switching gate has a substantially cylindrical shape, and includes first and second guide plates for defining the first reverse guide path, a third guide plate for defining the straight guide path together with the second guide plate, and a fourth guide plate for defining the second reverse guide path together with the third guide plate.

With this arrangement, a sheet conveyed via the image forming means can be reliably guided by the upper and lower guide plates disposed in the switching gate. Since the respective guide plates are disposed in the switching gate within the range of a revolving cylinder, the guide plates that constitute a fixed convey path upon rotation do not interfere with the switching operation of the switching gate, thereby simplifying the switching mechanism.

Also, it is effective to set a width of an opening of each of the guide paths of the switching gate larger than a width of an opening of the inlet path into which a sheet is conveyed through the image forming means. In this case, the leading end of a sheet is not caught by the opening edge to assure more reliable guiding of sheets.

According to another aspect of the present invention, there is provided a sheet discharge processing device for sequentially discharging sheets, sent through image forming means for forming images on the sheets on the basis of image data, onto a discharge tray with image-bearing surfaces of the sheets facing up or down, which comprising: first and second switchback convey paths being vertically arranged between an inlet path into which a sheet conveyed through the image forming means is conveyed and a discharge path for discharging a sheet onto the discharge tray, and the first and second switchback convey paths being adapted to reverse the front and back of sheets; a switching gate including a first reverse guide path for causing the first switchback convey path to communicate with the discharge path when the second switchback convey path communicates with the inlet path, a second reverse guide path for causing the second switchback convey path to communicate with the discharge path when the first switchback convey path communicates with the inlet path, and a straight guide path for causing the inlet path to communicate with the discharge path, and the switching gate being rotatably placed between the inlet path and the discharge path; first and second storing sections arranged at an upper end portion of the first switchback convey path and a lower end portion of the second switchback convey path to store sheets conveyed through the first and second switchback convey paths; and loop-like guide members, storing sheets conveyed from the first and second switchback convey paths into the first and second storing sections therein, respectively arranged in the first and second storing sections so as to smoothly convey the sheets.

According to the sheet discharge processing device having the above arrangement, since the loop-like guide member is formed at one end of each of the first and second switchback convey paths, the vertical size of the device is reduced, and a compact sheet discharge processing device can be realized.

If each of the loop-like guide members arranged in the first and second switchback convey paths has an inner diameter not less than 50 mm and not more than a diameter corresponding to the length of a maximum-size sheet to be processed, a reduction in size can be attained, and at the same time, sheets can be smoothly stored along the loop-like guide members.

Each of the loop-like guide members of the first and second switchback convey paths may be formed only on the outside and placed in an area corresponding to the central portion of a conveyed sheet. Alternatively, loop-like auxiliary guide members may be arranged symmetrically on the two sides of a guide member formed in correspondence with the central portion of a sheet, with each auxiliary guide member having a diameter larger than that of the central guide member. Alternatively, a guide member may be gradually tapered toward the downstream side. Alternatively, a guide member may be divided into a plurality of members, and the number of the members may be decreased toward the downstream side. With the above arrangement, the frictional resistance between the sheet and the guide member can be reduced. Therefore, a conveyed sheet can be guided and stored more smoothly without imposing a load on the sheet.

If the loop-like guide members of the first and second switchback convey paths are arranged to make sheets curl in the same direction, the sheets exhibit curling tendencies in the same direction, and can be stacked on the discharge tray in a good stacked state, thereby preventing a pile of sheets from collapsing, and the page order from being upset.

In addition, each of the loop-like guide members of the first and second switchback convey paths is formed such that the angle defined by an extended line of the leading end of a sheet guided to the distal end portion of the guide member and a tangent to the intersection between the extended line and the guide member is not more than 30°. Even if, therefore, the leading end of a given sheet collides with another conveyed sheet, the sheet can be smoothly guided and conveyed without causing the leading end of the sheet to bend.

According to another aspect of the present invention, there is provided a sheet discharge processing device for sequentially discharging sheets, sent through image forming means for forming images on the sheets on the basis of image data, onto a discharge tray with image-bearing surfaces of the sheets facing up or down, which comprises: first and second switchback convey paths being vertically arranged between an inlet path into which a sheet conveyed through the image forming means is conveyed and a discharge path for discharging a sheet onto the discharge tray, and the first and second switchback convey paths being adapted to reverse the front and the back of sheets; a switching gate including a first reverse guide path for causing the first switchback convey path to communicate with the discharge path when the second switchback convey path communicates with the inlet path, a second reverse guide path for causing the second switchback convey path to communicate with the discharge path when the first switchback convey path communicates with the inlet path, and a straight guide path for causing the inlet path to communicate with the discharge path, and the switching gate being rotatably placed between the inlet path and the discharge path; first and second convey rollers being respectively arranged on the first and second switchback convey paths, and the first and second convey rollers being able to be rotated in forward and reverse directions; first and second detection sensors being arranged between the first and second convey rollers and the switching gate to detect sheets conveyed into the first and second switchback convey paths; and control means for controlling rotation of the first and second convey rollers, and controlling a rotation position of the switching gate to reverse and discharge a sheet through the first or second switchback convey path when a trailing end of the sheet conveyed into one of the first and second switchback convey paths is detected by the first or second detection sensor, and discharge processing of a sheet in the other switchback convey path, which is different from the switchback convey path in which the trailing end of the sheet has been detected, is completed.

In this case, even if discharge processing of a preceding sheet is continued at the timing when the trailing end of a conveyed sheet is detected, since the switching gate is switched upon completion of the discharge processing, reliable switching control can be performed without causing damage to the trailing end of the sheet and the switching gate.

If the above control means performs switching control of the switching gate a predetermined period of time after the completion of conveyance of a sheet into one of the switchback convey paths is detected by the first or second detection sensor, and the completion of discharge processing of a sheet from the other switchback convey path is detected by the second or first detection sensor, switching control of the switching gate can be reliably performed without the trailing end of a sheet left therein regardless of the size of a sheet to be processed.

Assume that when a convey abnormality of a preceding sheet discharged through one of the switchback convey paths is detected, the control means stops a convey operation in the switchback convey path, stops a convey operation for a succeeding sheet after it is completely conveyed into the other switchback convey path, and switches the switching gate after the preceding sheet is removed, thereby processing a sheet on which an image identical to an image formed on the preceding sheet is formed ahead of the succeeding sheet. In this case, only the sheet having the convey abnormality is wasted, and sheets can be discharged in the page order without wasting the succeeding sheet.

According to still another aspect of the present invention, there is provided a sheet discharge processing device for sequentially discharging sheets, sent through image forming means for forming images on the sheets on the basis of image data, onto a discharge tray with image-bearing surfaces of the sheets facing up or down, which comprises: first and second switchback convey paths being vertically arranged between an inlet path into which a sheet conveyed through the image forming means is conveyed and a discharge path for discharging a sheet onto the discharge tray, and the first and second switchback convey paths being adapted to reverse the front and back of sheets; a switching gate including a first reverse guide path for causing the first switchback convey path to communicate with the discharge path when the second switchback convey path communicates with the inlet path, a second reverse guide path for causing the second switchback convey path to communicate with the discharge path when the first switchback convey path communicates with the inlet path, and a straight guide path for causing the inlet path to communicate with the discharge path, and the switching gate being rotatably placed between the inlet path and the discharge path; first and second convey rollers being respectively arranged on the first and second switchback convey paths, and the first and second convey rollers being able to be rotated in forward and reverse directions; first and second detection sensors being arranged between the first and second convey rollers and the switching gate to detect sheets conveyed into the first and second switchback convey paths; timer means in which a time taken for a trailing end of a sheet discharged from the first or second switchback convey path to pass completely through one of the reverse guide paths of the switching gate is set in advance, and the timer means starting to count the set time in response to starting a discharge operation for a sheet; and control means for controlling rotation of the first and second convey rollers, and controlling a rotation position of the switching gate to reverse and discharge a sheet through the first or second switchback convey path after a trailing end of the sheet conveyed into one of the first and second switchback convey paths is detected by the first or second detection sensor, and it is determined that the timer means has completely counted the set time.

In this arrangement, the timer means starts to perform a time counting operation when a discharge operation of a sheet conveyed into one of the switchback convey paths is started, and the completion of the time counting operation of the timer means is checked after it is detected that conveyance of a sheet into the other switchback convey path is completed, thereby accurately checking the time point at which the trailing end of the sheet is not present in the switching gate.

If the timer means is set in accordance with the size of a sheet conveyed into the first or second switchback convey path, the time point at which the trailing end of a sheet reliably passes through the switching gate can be accurately detected regardless of the size of the sheet to be processed. No problem is therefore posed in terms of the switching timing of the switching gate.

If the timer means is set on the basis of a time obtained by starting a time counting operation when the first or second detection sensor placed on the first or second switchback convey path detects the leading end of a conveyed sheet, and stopping the time counting operation when the sensor detects the trailing end of the sheet, a time setting operation based on the sheet size can be reliably performed even if the sheet to be processed is a non-standard-size sheet.

Further advantages and features of the invention as well as the scope, nature and utilization of the invention will become apparent to those skilled in the art from the description of the preferred embodiments of the invention set forth below.

BRIEF DESCRIPTION OF THE DRAWINGS

FIG. 22A is a view showing a state wherein a sheet is guided into the upper reverse path, and FIG. 22B is a view showing a state wherein a sheet is guided into the lower reverse path.

DESCRIPTION OF THE PREFERRED EMBODIMENTS

Embodiments of the sheet discharge processing device of the present invention which performs discharge processing of a sheet having undergone image formation in an image forming apparatus will be described below with reference to the accompanying drawings.

Figure 1:
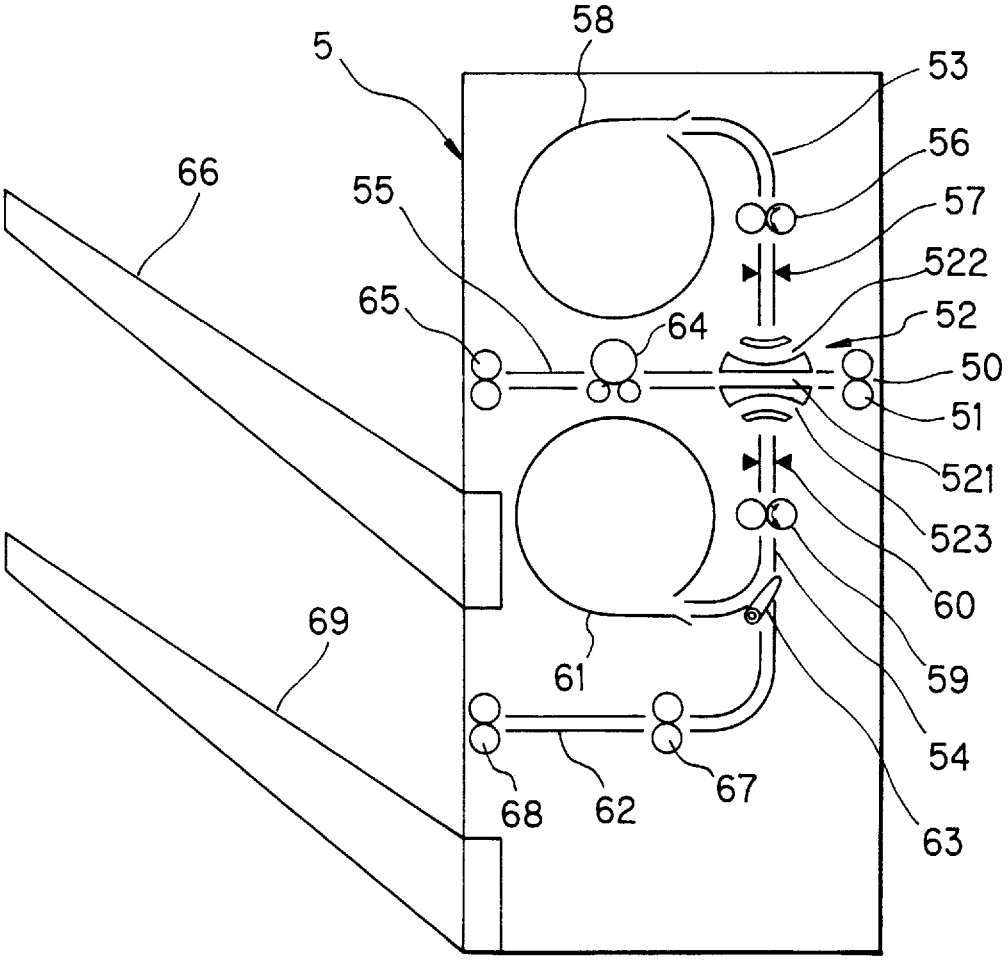
FIG. 1 is a front longitudinal sectional view showing the internal structure of a sheet discharge processing device according to an embodiment of the present invention.
Figure 2:
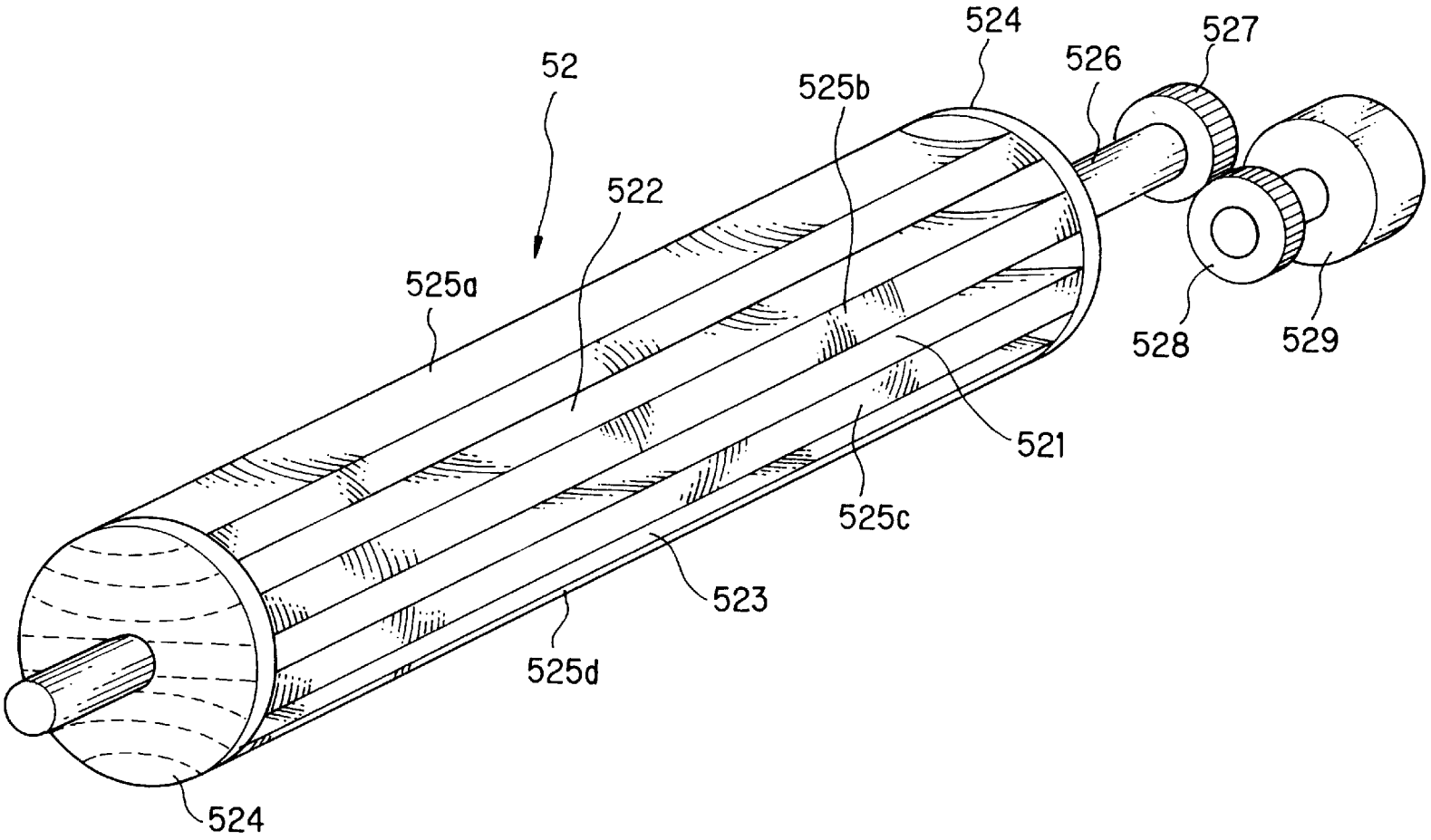
FIG. 2 is a perspective view showing the detailed structure of a switching gate for switching the convey paths constituting the sheet discharge processing device of the present invention.
Figure 3:
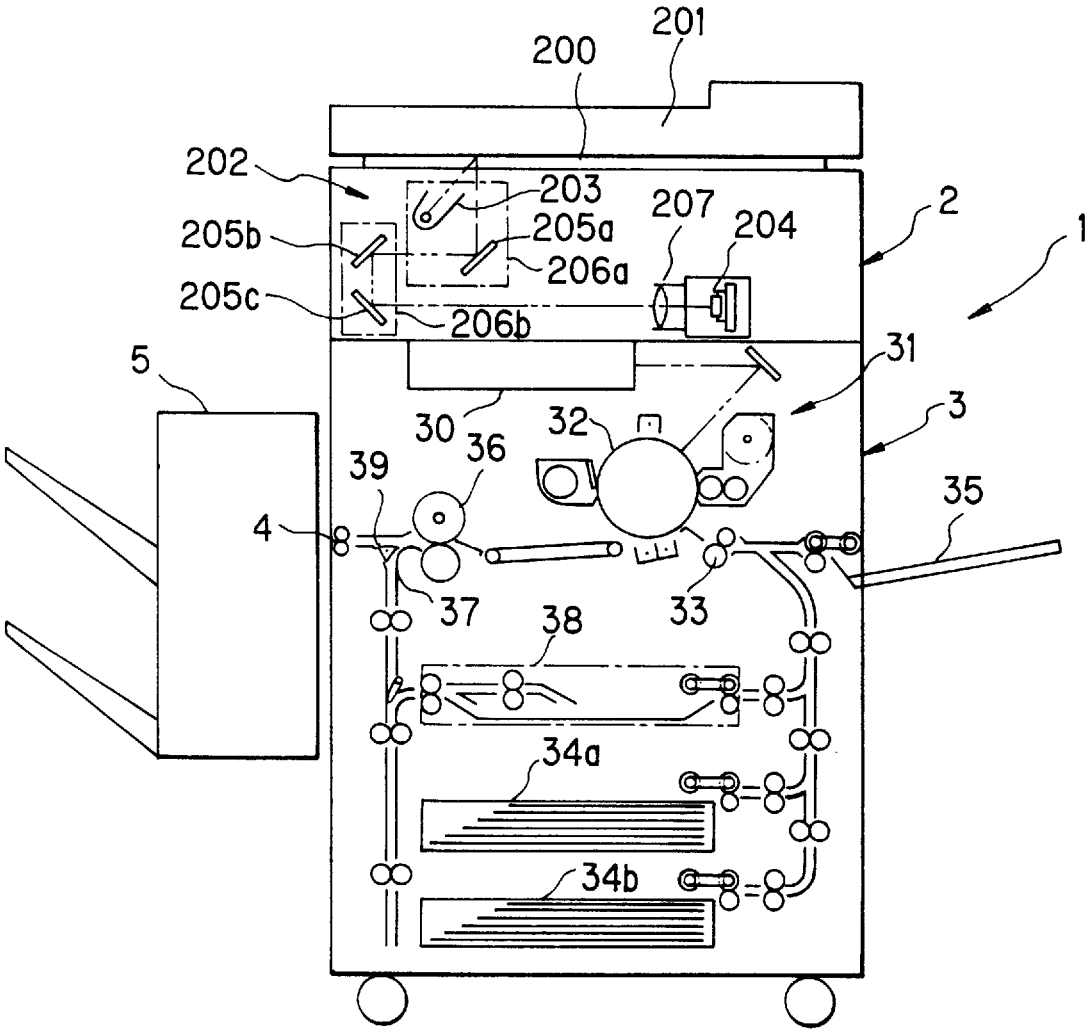
FIG. 3 is a front longitudinal sectional view showing the overall structure of a digital copying machine including the sheet discharge processing device of the present invention.

The present invention relates to a sheet discharge processing device mounted in the paper discharge section of a digital image forming apparatus having a copy mode, a printer mode, a facsimile mode, and the like. FIG. 1 is a front longitudinal sectional view showing an embodiment of the sheet discharge processing device of the present invention. FIG. 2 is a perspective view showing the outer appearance of a switching gate according to the present invention which causes the sheet feed direction to branch off. FIG. 3 is a front longitudinal sectional view showing the overall structure of the digital image forming apparatus including the sheet discharge processing device in FIG. 1.

The structure of the image forming apparatus will be described first with reference to FIG. 3. This digital image forming apparatus is a digital copying machine. A copying machine body 1 is mainly constituted by a scanner section 2 and a laser recording section 3.

The scanner section 2 is constituted by an original-placed table 200 made of transparent glass, a reversible automatic document feeder (RADF) 201 for automatically feeding an original onto the original-placed table 200, and an original image read unit, i.e., a scanner unit 202, for scanning and reading an image on an original placed on the original-placed table 200.

The original image read by the scanner section 2 is sent as image data to an image data input section (to be described later), in which predetermined image processing is performed for the image data.

The RADF 201 is a device for automatically feeding originals set on an original tray (not shown), one by one, onto the original-placed table 200. The RADF 201 is constituted by a convey path for one-sided originals, a convey path for double-sided convey path, a convey path switching means, and the like to allow the scanner unit 202 to read one or two surfaces of an original in accordance with selection made by the operator. With regard to the RADF 201, many patent applications have been filed, and many devices have become commercially available, and hence a further description of this device will be omitted.

The scanner unit 202 as a part of the scanner section 2 for reading an image on an original placed on the original-placed table 200 comprises a first scanning unit 206*a* having a lamp reflector assembly 203 for exposing the original surface and a first reflecting mirror 205*a* for reflecting light reflected by the original to guide the reflected light image from the original to a photoelectric conversion element 204, a second scanning unit 206*b* having second and third reflecting mirrors 205*b* and 205*c* for guiding the reflected light image from the first reflecting mirror 205*a* to the photoelectric conversion element (CCD) 204, an optical lens body 207 for forming the reflected light image from the original on the element (CCD) 204, which serves to convert the reflected light image into an electrical signal, via the reflecting mirrors 205*a*, 205*b*, and 205*c*, and the CCD 204 for converting the reflected light image from the original into an electrical image signal.

In the scanner section 2, while originals to be read are sequentially placed on the original-placed table 200 upon interlocking operation between the RADF 201 and the scanner unit 202, the scanner unit 202 is moved along the lower surface of the original-placed table 200 to read original images. The first scanning unit 206*a* is driven to travel along the original-placed table 200 from left to right at a constant velocity V, and the second scanning unit 206*b* is controlled to travel parallel in the same direction at a velocity V/2. With this operation, an image on an original placed on the original-placed table 200 is sequentially formed on the CCD 204 line by line, thereby reading the image.

The image data obtained by reading the original image with the scanner unit 202 is sent to an image processing unit (to be described later), in which various processes are performed. The resultant data is temporarily stored in the memory of the image processing unit. In response to an output instruction, the image data in the memory is supplied to the laser recording section 3 to form an image on paper.

This laser recording section 3 includes a convey system for a sheet as paper on which image is to be formed, a laser write unit 30, and an electrophotographic process section 31 for forming an image.

The laser write unit 30 includes a semiconductor laser for emitting a laser beam in accordance with image data read by the scanner unit 202 and read out from the memory, or image data transferred from an external apparatus, a polygon mirror for performing constant-angular-velocity deflection of the laser beam, an f-θ lens for correcting the laser beam having undergone constant-angular-velocity deflection to undergo constant-velocity deflection on a photosensitive drum 32 as a part of the electrophotographic process section 31, and the like.

The electrophotographic process section 31 includes a charger, a developing unit, a transfer unit, a peeling unit, a cleaning unit, and a charge remover around the photosensitive drum 32 as a known member.

The sheet convey system includes a convey section 33 for conveying a sheet to the transfer position, of the electrophotographic process section 31 for performing the above image forming operation, in particular at which the transfer unit is placed, cassette paper feeders 34*a* and 34*b* for feeding a sheet into the convey section 33, a manual paper feeder 35 for feeding a sheet of a necessary size, as needed, a fixing unit 36 for fixing the image transferred onto the sheet, i.e., the toner image, on the sheet, a switchback convey path 37 for reversing the sheet to allow an image to be formed on the lower surface of the sheet having undergone the fixing operation, i.e., to allow images to be formed on the upper and lower surfaces of the sheet, and an intermediate tray 38 for storing a sheet which passes through the convey path 37.

A switching pawl 39 for switching the convey path of a sheet to the switchback convey path 37 is placed on the downstream side of the fixing unit 36. The switching pawl 39 switches the convey path of a sheet having undergone image formation to the convey path through which the sheet is conveyed to a sheet discharge processing device 5 via a discharge section 4.

Sheets of predetermined sizes desired by the operator are stored in the cassette paper feeders 34*a* and 34*b* of the above sheet convey system. The manual paper feeder 35 is used to feed a small number of sheets of sizes desired by the operator. The operator selects one of the paper sizes of the paper feed cassettes or the manual paper feeder 35 to feed a sheet of a desired size.

In the laser write unit 30 and the electrophotographic process section 31, image data read out from the image memory is formed as an electrostatic latent image on the surface of the photosensitive drum 32 when a laser beam is scanned by the laser write unit 30, and the latent image is visualized by toner. When a toner image is thus formed on the surface of the photosensitive drum 32, a sheet of a selected size is fed from one of the cassette paper feeders 34*a* and 34*b* or the manual paper feeder 35 to the transfer unit via the convey section 33. As a result, the toner image on the surface of the photosensitive drum 32 is transferred onto the upper surface of the sheet, and the sheet is conveyed to the fixing unit 36, in which a fixing operation is performed. After the image is fixed on the sheet, the sheet having undergone image formation is conveyed to the sheet discharge processing device 5 via the discharge section 4.

The arrangement and function of the image processing unit in this copying machine body 1 which performs image processing for read original image information will be described next.

Figure 4:
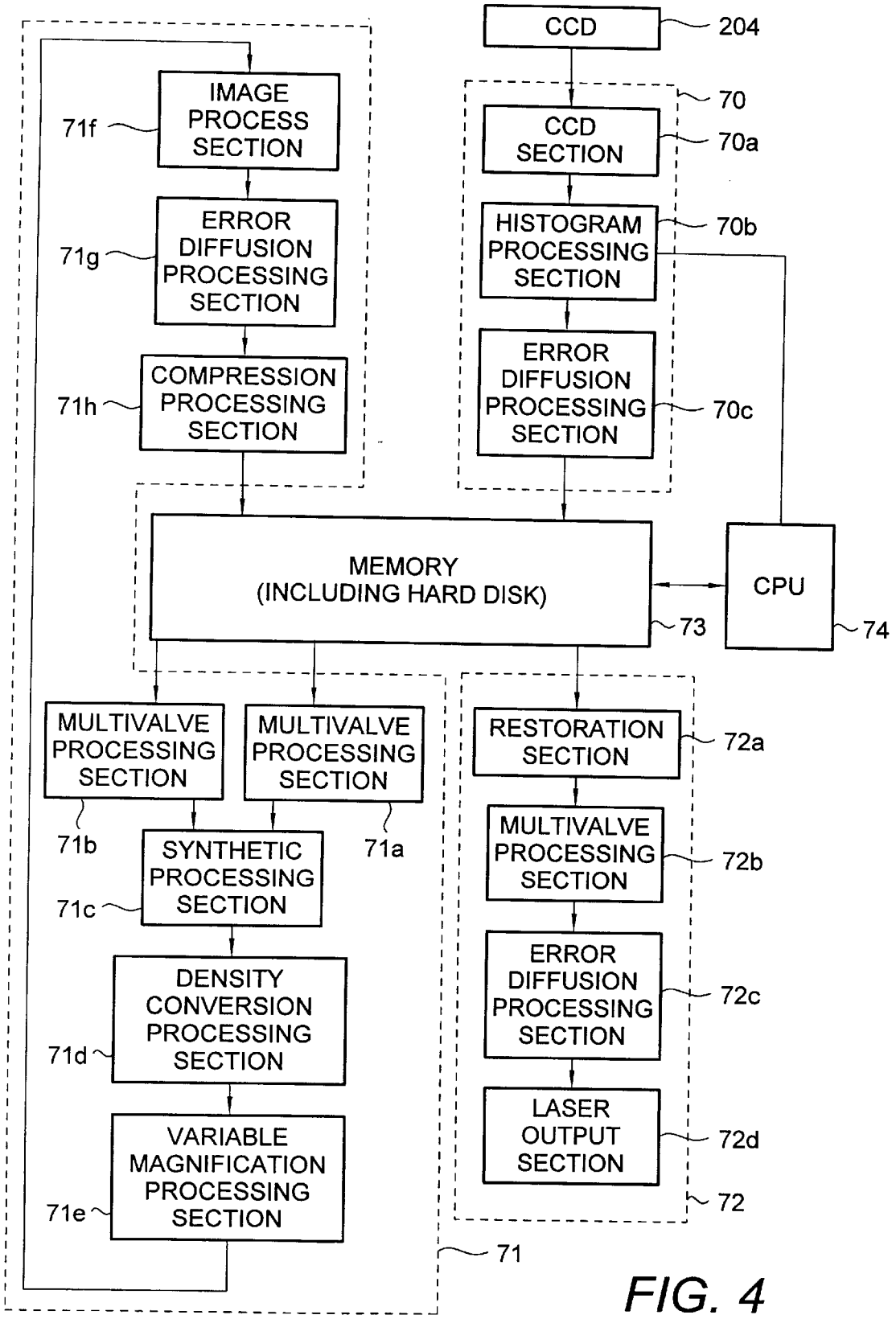
FIG. 4 is a block diagram showing the circuit arrangement of the image processing section of the digital copying machine.

FIG. 4 is a block diagram showing the image processing unit included in the copying machine body 1 in FIG. 3. The image processing unit included in the copying machine body 1 has an image data input section 70, an image processing section 71, an image data output section 72, a memory 73 constituted by a RAM (random access memory), a hard disk, and the like, and a central processing unit (CPU) 74.

The image data input section 70 includes a CCD section 70*a*, a histogram processing section 70*b*, and an error diffusion processing section 70*c*. The image data input section 70 binarizes the original image data received from the CCD 204, processes the image data by the error diffusion method while generating a histogram as a binary digital amount, and temporarily stores the data in the memory 73.

In the CCD section 70*a*, an analog electrical signal corresponding to the pixel density of each image data is A/D-converted, and MTF correction, black-and-white correction, or gamma correction is performed. The resultant data is outputted as a 256-level (8-bit) digital signal to the histogram processing section 70*b*.

In the histogram processing section 70*b*, density information (histogram data) is obtained by adding digital signals outputted from the CCD section 70*a* for each of the 256-level pixel densities. In addition, the obtained histogram data is sent to the central processing unit 74, or is sent as pixel data to the error diffusion processing section 70*c*, as needed.

In the error diffusion processing section 70*c*, an 8-bit/pixel digital signal outputted from the CCD section 70*a* is converted into 1-bit (binary) data by the error diffusion method as a type of pseudo-halftone processing, i.e., a method of reflecting a binarization error or binarization determination of adjacent pixels, and a re-distribution operation is performed to faithfully reproduce the local area densities of the original.

The image processing section 71 includes multivalue processing sections 71*a* and 71*b*, a synthetic processing section 71*c*, a density conversion processing section 71*d*, a variable magnification processing section 71*e*, an image process section 71*f*, an error diffusion processing section 71*g*, and a compression processing section 71*h*.

The image processing section 71 serves to finally convert input image data into image data desired by the operator. The image processing section 71 is designed to perform image processing until the processed data is finally stored as converted output image data in the memory 73. Note that the above processing sections included in the image processing section 71 operate as needed, but may not operate in some case. The multivalue processing sections 71*a* and 71*b* convert data binarized by the error diffusion processing section 70*c* into 256-level data again.

The synthetic processing section 71*c* selectively performs a logical operation for each pixel, i.e., an OR operation, an AND operation, or an exclusive OR operation. Data to be subjected to this operation includes pixel data stored in the memory 73 and bit data from a pattern generator (PG).

In the density conversion processing section 71*d*, an arbitrary relationship between the input and output densities is set for the 256-level data signal on the basis of a predetermined gradation conversion table. The variable magnification processing section 71*e* performs interpolation processing with input known data in accordance with a designated magnification to obtain pixel data (density value) for each pixel after variable magnification processing. As a result, after variable magnification processing in the sub-scannig direction, variable magnification processing in the main scanning direction is performed. The image process section 71*f* performs various image processes for input pixel data, and acquires information about a data string by, for example, extracting features. The error diffusion processing section 71*g* performs the same processing as that performed by the error diffusion processing section 70*c* of the image data input section 70. The compression processing section 71*h* compresses binary data by run-length coding. Image data is compressed in the final processing routine when final output image data is completed.

The image data output section 72 includes a restoration section 72*a*, a multivalue processing section 72*b*, an error diffusion processing section 72*c*, and a laser output section 72*d*. The image data output section 72 restores the compressed image data stored in the memory 73, converts the data into the original 256-level data, performs error diffusion of quaternary data as a halftone expression smoother than binary data, and transfers the resultant data to the laser output section 72*d*.

More specifically, the restoration section 72*a* restores the image data compressed by the compression processing section 71*h*. The multivalue processing section 72*b* performs the same processing as that performed by the multivalue processing sections 71*a* and 71*b* of the image processing section 71. The error diffusion processing section 72*c* performs the same processing as that performed by the error diffusion processing section 70*c* of the image data input section 70. In the laser output section 72*d*, digital pixel data is converted into an ON/OFF signal for the laser on the basis of a control signal from a sequence controller (not shown), and the semiconductor laser in the laser write unit 30 is turned on/off to write an electrostatic latent image on the photosensitive drum 32.

Data to be processed by the image data input section 70 and the image data output section 72 are basically stored as binary data in the memory 73 to reduce the capacity of the memory 73. However, data may be processed in the form of quaternary data in consideration of a deterioration in image quality.

Figure 5:
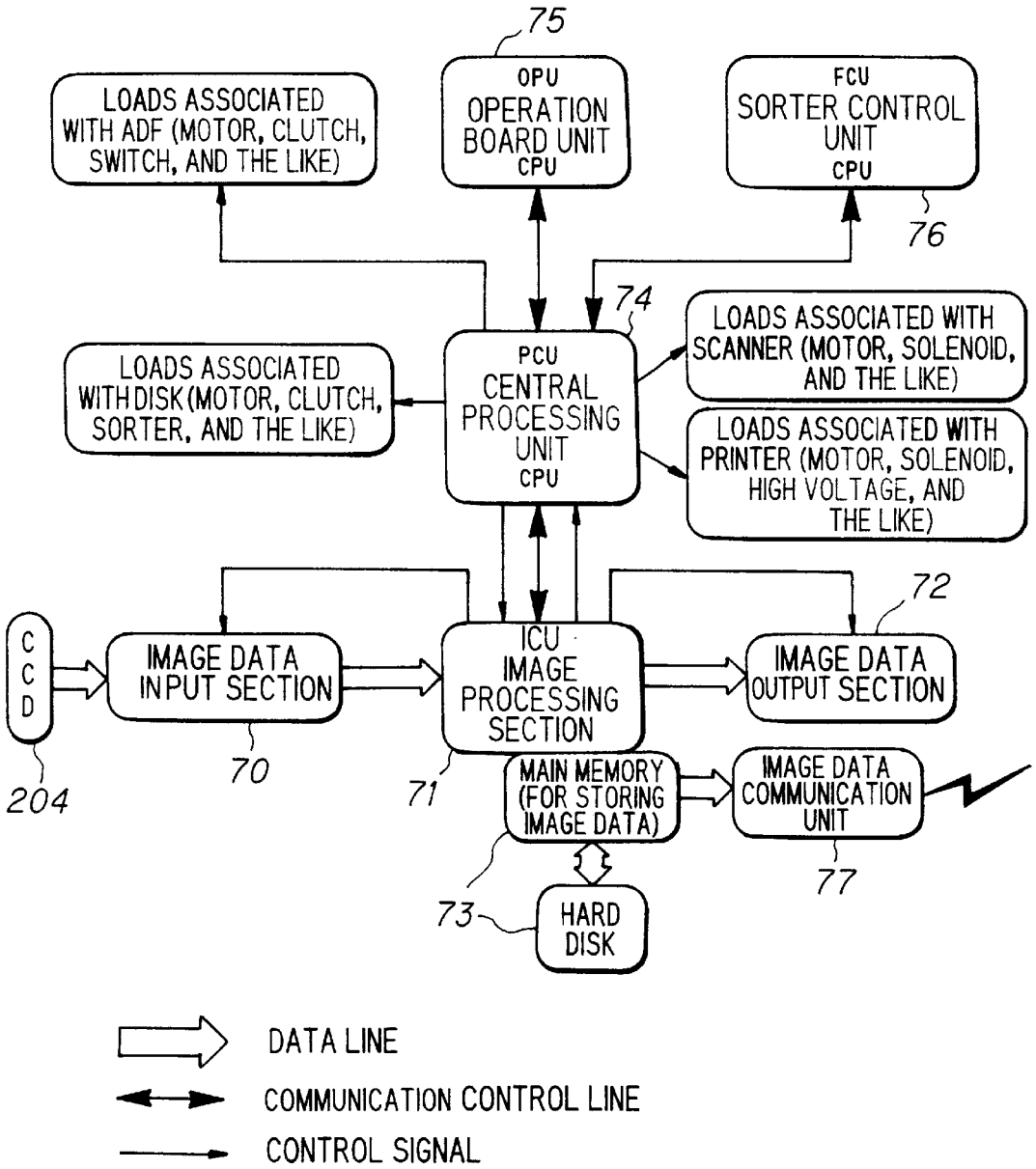
FIG. 5 is a block diagram showing the overall control arrangement for image processing and sheet discharge processing, including the image processing section of the digital copying machine.

FIG. 5 shows how the central processing unit (CPU) 74 manages the operations of the respective sections in the overall copying machine body 1. The CCD 204, the image data input section 70, the image processing section 71, the image data output section 72, the memory 73, and the central processing unit (CPU) 74 are the same as those described above, and hence a description thereof will be omitted.

The central processing unit 74 manages the respective mechanisms, e.g., the RADF 201, the scanner section 2, and the laser recording section 3 described with reference to FIG. 3, which constitute the digital copying machine by sequence control, and outputs control signals to the respective sections.

An operation board unit 75 constituted by an operation panel is connected to the central processing unit 74 so as to allow mutual communication. The operation board unit 75 transfers a control signal to the central processing unit 74 in accordance with the copy mode set by the operator, thereby controlling the operation of the copying machine body 1 in accordance with various set modes.

The central processing unit 74 transfers a control signal indicating the operation state of the copying machine body 1 to the operation board unit 75. The operation board unit 75 then causes the display section to display the operation state in accordance with this control signal to show the operator the current state of the apparatus.

A sorter control unit 76 is a control unit for managing the operation of the discharge processing device for sorting copies and the like outputted from the copying machine body 1. That is, the sorter control unit 76 is a unit for performing various control operations in the sheet discharge processing device 5 in FIG. 1.

An image data communication unit 77 serves to communicate pieces of information such as image information and control signals with other digital image devices.

Figure 6:
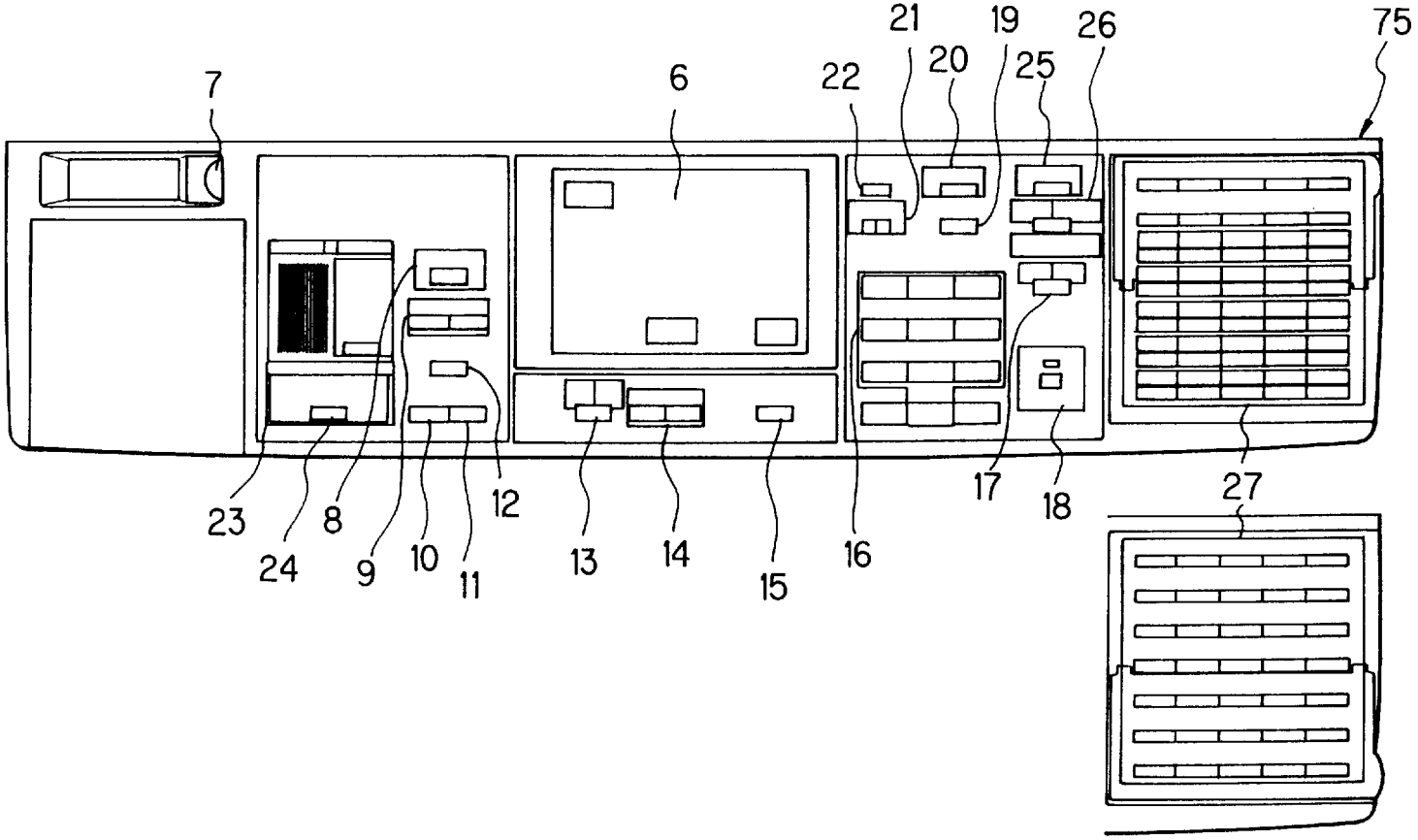
FIG. 6 is a plan view showing an example of the operation panel portion of the digital copying machine.

FIG. 6 is a plan view showing the detailed arrangement of the operation panel of the operation board unit 75 in the copying machine body 1. A touch panel liquid crystal display device 6 is placed in the central portion of the operation panel, and various mode setting keys are arranged around the touch panel liquid crystal display device 6.

A screen switching designation area for switching the current screen to a screen for allowing the operator to select an image editing function is always displayed on the screen of the touch panel liquid crystal display device 6. When this area is directly pressed with a finger of the operator, a list of editing functions is displayed on the liquid crystal screen to allow the operator to select an image editing function. When the operator touches an area in which a desired function of the displayed editing functions is displayed, the desired editing function is set.

The setting keys arranged on the operation panel will be briefly described with reference to the appended reference numerals. Reference numeral 7 denotes a dial for adjusting the brightness of the screen of the touch panel liquid crystal display device 6.

Reference numeral 8 denotes an automatic magnification setting key for setting a mode of automatically selecting a magnification; 9, a zoom key for setting a copy magnification in increments of 1%; 10 and 11, fixed magnification keys for reading out and selecting fixed magnifications; and 12, a one-to-one magnification key for restoring the copy magnification to the standard magnification (one-to-one magnification).

Reference numeral 13 denotes a density switching key for switching the copy density adjustment mode from the automatic mode to the manual mode or the photographic mode; 14, a density adjustment key for finely setting a density level in the manual or photographic mode; and 15, a tray selection key for selecting a desired paper size from the paper sizes of sheets set in the paper feed section of the copying machine.

Reference numeral 16 denotes a copy count setting key for setting the number of copies; 17, a clear key to be operated to clear the number of copies or stop a continuous copy operation; 18, a start key for designating the start of a copy operation; 19, an all cancel key for canceling all the currently set modes and restoring the standard state; 20, an interrupt key to be operated to perform a copy operation for another original during a continuous copy operation; 21, an operation guide key which is operated, when the operator does not know how to operate the copying machine, to display an operation method of the copying machine with a message; and 22, a message forward scrolling key for displaying the remaining part of the message displayed upon operation of the operation guide key 21.

Reference numeral 23 denotes a double-sided mode setting key for setting the double-sided copy mode; and 24, a discharge processing mode setting key for setting the operation mode of the sheet discharge processing device 5 for sorting copies discharged from the copying machine.

Reference numerals 25 to 27 denote setting keys associated with the printer and facsimile modes. More specifically, reference numeral 25 denotes a memory transmission mode key for setting a mode of temporarily storing transmission original data in a memory and transmitting the data afterward; 26, a copy/fax·printer mode switching key for switching the mode of the digital copying machine between the copy mode and the fax·printer mode; and 27, a one-touch dial key for allowing the operator to make a call to a destination, the telephone number of which has been stored in advance, with a one-touch operation.

An embodiment of the sheet discharge processing device mounted in the digital image forming apparatus of the present invention will be described in detail below with reference to FIG. 1. The sheet discharge processing device 5 receives sheets having undergone image formation in the above copying machine body 1, and collates the sheets. The sheet discharge processing device 5 reverses and conveys sheets in accordance with the printer mode or the facsimile mode. In addition, the sheet discharge processing device 5 reverses and discharges sheets or discharges sheets without changing their postures in accordance with an instruction manually inputted through the above operation panel.

When a sheet having undergone image formation is conveyed from the discharge section 4 on the copying machine body 1 side, the sheet is guided into the sheet discharge processing device 5 via a sheet reception opening (inlet) 50.

Inlet rollers 51 for conveying the carried sheet are arranged at the inlet 50. A rotary switching gate 52 according to the present invention is placed at the exit side of the inlet rollers 51. The switching gate 52 has paths for changing the feed direction of an image-formed sheet conveyed through the inlet rollers 51. First and second switchback convey paths 53 and 54 are formed in the vertical direction, and a discharge path 55 is formed on the left side of the switching gate 52, i.e., on the downstream side in the convey direction of a sheet, in such a manner that each of the paths communicates with a corresponding path of the switching gate 52 when it rotates.

The first switchback convey path 53 has first convey rollers 56 capable of rotating in the forward and reverse directions and serving to convey a sheet guided to the switchback position to the downstream side of the first switchback convey path 53, a first detection sensor 57 for detecting the sheet conveyed to the first convey rollers 56, and a first storing section 58 formed into a cylinder or loop and serving to guide and store the sheet conveyed by the first convey rollers 56.

The second switchback convey path 54, which is symmetrical with the first switchback convey path 53 about the switching gate 52, has second convey rollers 59 capable of rotating in the forward and reverse directions and serving to convey a sheet guided to the switchback position to the downstream side of the second switchback convey path 54, a second detection sensor 60 for detecting the sheet conveyed to the second convey rollers 59, and a second storing section 61 formed into a cylinder or loop and serving to guide and store the sheet conveyed by the second convey rollers 59. The second switchback convey path 54 further has a second discharge path 62 branching off from the convey path extending to the second storing section 61, and a switching pawl 63 placed at the branching position to switch the respective convey paths.

In addition, the first discharge path 55 has curl removing rollers 64 for removing the curling tendency of a sheet, i.e., a curl, and first discharge rollers 65 for discharging the sheet out of the sheet discharge processing device 5. A first discharge tray 66 on which discharged sheets are sequentially stacked extends from the sheet discharge processing device 5 in correspondence with the first discharge rollers 65.

The second discharge path 62 has third convey rollers 67 for conveying a received sheet, second discharge rollers 68, and a second discharge tray 69 for receiving the sheet discharged by the second discharge rollers 68. The second discharge tray 69 is placed below the first discharge tray 66.

As shown in FIG. 1, three paths are formed in the switching gate 52 of the present invention having the above arrangement. As shown in FIG. 1, these paths are: a straight guide path 521 for guiding a sheet conveyed by the inlet rollers 51 to the discharge path 55 without changing the state of the sheet; a first reverse guide path 522 for guiding a sheet conveyed by the inlet rollers 51 to the first switchback convey path 53, and reversely guiding the sheet from the first switchback convey path 53 to the discharge path 55; and a second reverse guide path 523 for guiding a sheet from the inlet rollers 51 to the second switchback convey path 54, and reversely guiding the sheet from the second switchback convey path 54 to the discharge path 55.

As shown in detail in FIG. 2, in order to form the above paths, the switching gate 52 is constituted by two circular side plates 524 and four guide plates 525*a* to 525*d* arranged therebetween with the two ends of each guide plate fixed to the two side plates. The guide plates 525*a* and 525*b* are symmetrical in shape and position with the guide plates 525*c* and 525*d* about the straight guide path 521. The guide plates 525*a* and 525*d* are formed such that the surfaces defining the first and second reverse guide paths 522 and 523 protrude toward the central axis of the switching gate 52 in the form of arcs. The guide plates 525*b* and 525*c* are formed such that the surfaces defining the first and second reverse guide paths 522 and 523 recede toward the outer circumferential surface of the switching gate 52 in the form of arcs.

A rotating shaft 526 extending through the center of each side plate 524 of the switching gate 52 is rotatably supported on two frames of the sheet discharge processing device 5 via bearings (not shown). The two frames support the respective members constituting the sheet discharge processing device 5. A gear 527 is fixed on one end portion of the rotating shaft 526, and a stepping motor 529 is coupled to the rotating shaft 526 via a drive gear 528 meshed with the gear 527. With this structure, the switching gate 52 is rotated upon rotation of the stepping motor 529. The rotation position of the stepping motor 529 is controlled by a known detection means.

According to the switching gate 52 of the present invention, the guide plates 525*a* to 525*d* are fit into the cylindrical shape defined when the switching gate 52 rotates. That is, the guide plates 525*a* to 525*d* are formed such that they do not protrude from the rotating outer circumferential surface. For this reason, the rotating guide plates 525*a* to 525*d* are not caught on the end portions of the guides defining the fixed inlet and outlet paths and the switchback paths, and hence the switching gate 52 can be smoothly rotated with a simple mechanism.

In the above structure, first of all, the convey direction of a sheet received through the inlet 50 is determined by the switching gate 52, and the sheet is guided to an appropriate convey path in accordance with the position of the switching gate 52. Thereafter, the sheet is discharged onto the discharge tray 66 or 69. When a sheet is to be discharged with the image-bearing surface facing up, the straight guide path 521 of the switching gate 52 causes the inlet path at the inlet 50 to communicate with the discharge path 55 so as to guide the sheet to the first discharge tray 66 without changing its posture.

When sheets are to be discharged with the image-bearing surfaces facing down, the first and second reverse guide paths 522 and 523 of the switching gate 52 cause the first or second switchback convey path 53 or 54 to communicate with the inlet 50, and simultaneously cause the second or first switchback convey path 54 or 53 to communicate with the discharge path 55. With this operation, the sheets are sequentially discharged onto the first discharge tray 66 with the image-bearing surfaces facing down.

The structure of the sheet discharge processing device 5 has been described above. When the switching gate 52 for switching the convey paths is at the position shown in FIG. 1, the device is in the standby state in the general copy mode.

In this state, a sheet conveyed from the copying machine body 1 side is guided to the straight guide path 521 of the switching gate 52 and discharged onto the first discharge tray 66 with the image-bearing surface facing up.

Figure 7:
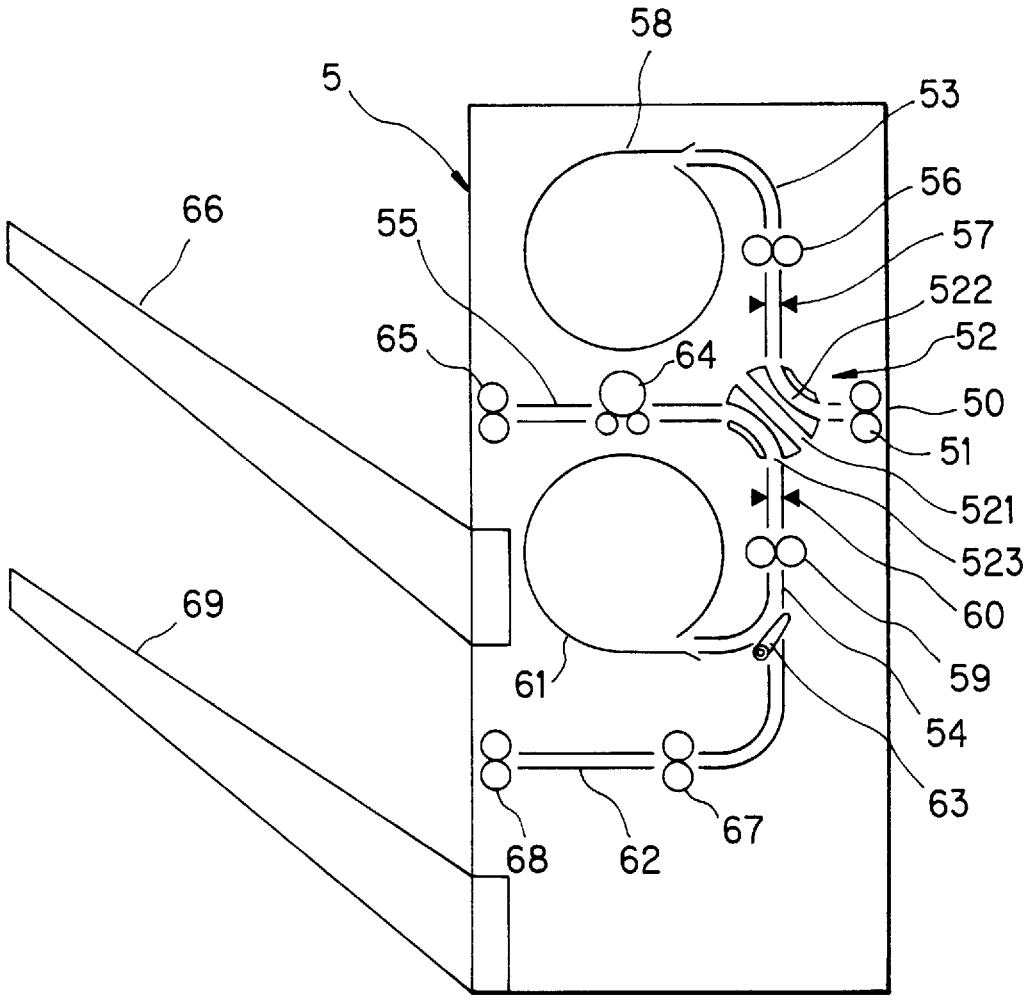
FIG. 7 is a view for explaining a sheet processing operation of the sheet discharge processing device of the present invention.

The operation of the sheet discharge processing device 5 in a case wherein the copying machine body 1 records images on sheets and sequentially discharge them in the printer mode will be described next with reference to FIGS. 7 and 8.

When the copying machine body 1 starts to output image data in the printer mode, the switching gate 52 on the sheet discharge processing device 5 side is rotated through 45° clockwise from, for example, the state shown in FIG. 1 and switched to the state shown in FIG. 7 in advance by driving the stepping motor 529, as described with reference to FIG. 2.

In this state, a sheet conveyed from the discharge section 4 on the copying machine body 1 side is guided from the inlet 50 into the sheet discharge processing device 5 through the inlet rollers 51. With this operation, the sheet is guided by the first reverse guide path 522 of the switching gate 52 to be conveyed, from the leading end, into the first switchback convey path 53 upon clockwise rotation (forward rotation) of the first convey rollers 56. The first convey rollers 56 convey the sheet to the loop-like first storing section 58 placed on a portion on the downstream side of the first switchback convey path 53 while clamping the sheet until the trailing end of the sheet is detected by the first detection sensor 57.

When the trailing end of the sheet is detected by the first detection sensor 57, the first convey rollers 56 rotate in the reverse direction (counterclockwise in FIG. 7) to start conveying the sheet from the first switchback convey path 53 with the trailing end of the sheet traveling first. At the same time, the switching gate 52 is rotated through 90° in the counterclockwise direction in FIG. 7 to switch the state in FIG. 7 to the state in FIG. 8. With this operation, the first reverse guide path 522 of the switching gate 52 causes the first switchback convey path 53 to communicate with the discharge path 55, and the second reverse guide path 523 of the switching gate 52 causes the inlet 50 to communicate with the second switchback convey path 54.

As a result, the preceding sheet is conveyed to the discharge path 55 via the first reverse guide path 522 of the switching gate 52, and the curl of the sheet is removed by the curl removing rollers 64 arranged midway along the path extending to the discharge path 55. Thereafter, the sheet is discharged onto the first discharge tray 66 with the image-bearing surface facing down.

Figure 8:
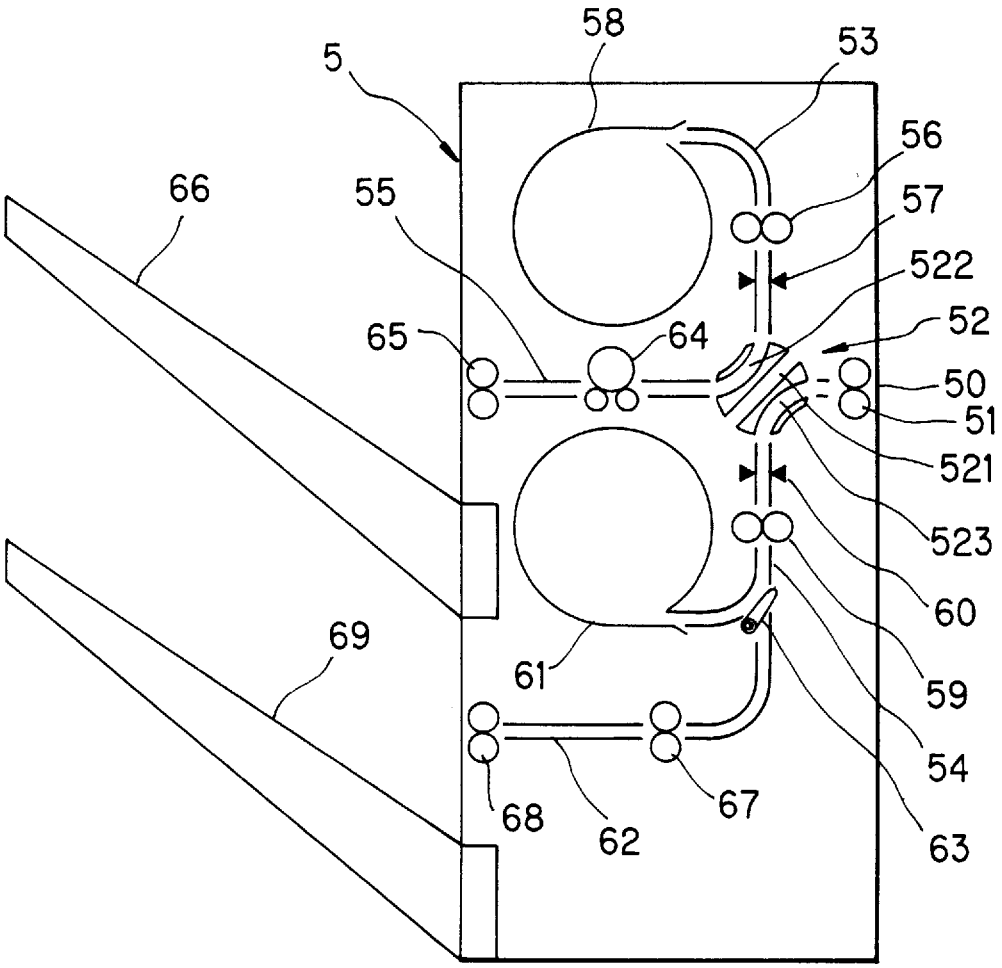
FIG. 8 is a view for explaining a sheet processing operation of the sheet discharge processing device of the present invention.

When the switching gate 52 is at the position in FIG. 8, a sheet on which the image of the succeeding page is formed is conveyed from the copying machine body 1 side to the second switchback convey path 54 via the second reverse guide path 523. The flow of the sheet is basically the same as in the above case wherein the sheet is conveyed to the first switchback convey path 53.

When the second detection sensor 60 detects the trailing end of the sheet, it is detected that conveyance of the sheet to the second switchback convey path 54 is completed. As a result, the switching gate 52 is rotated through 90° clockwise, and the state of the switching gate 52 in FIG. 8 is switched to the state in FIG. 7, as described above. With this operation, the first reverse guide path 522 of the switching gate 52 causes the inlet 50 to communicate with the first switchback convey path 53, and the second reverse guide path 523 of the switching gate 52 causes the second switchback convey path 54 into which the sheet is conveyed to communicate with the discharge path 55. The succeeding sheet conveyed into the second switchback convey path 54 is therefore guided to the discharge path 55 through the second reverse guide path 523 of the switching gate 52. This sheet is also discharged onto the preceding sheet on the first discharge tray 66 placed outside the sheet discharge processing device 5, with the image-bearing surface facing down, via the curl removing rollers 64 arranged midway along the discharge path 55.

By sequentially repeating the above operations, image-formed sheets from the copying machine body 1 side are sequentially stacked on the first discharge tray 66 with the image-bearing surfaces facing down.

A sheet processing operation of the sheet discharge processing device 5 in a case wherein the copying machine body 1 sequentially outputs received image data in the facsimile mode will be described below.

When the copying machine body 1 starts to perform a recording operation in the facsimile mode, the switching gate 52 is pivoted through 45° counterclockwise to be switched to the position in FIG. 8. A sheet discharged from the discharge section 4 on the copying machine body 1 side is guided into the sheet discharge processing device 5 through the inlet 50. Since the second reverse guide path 523 of the switching gate 52 ensures a path to the second switchback convey path 54, this sheet is guided into the second switchback convey path 54.

As described above, when the facsimile mode is set, the switching pawl 63 in the state shown in FIG. 8 is switched to open the path to the second discharge path 62 and close the path to the second storing section 61 on the downstream side of the second switchback convey path 54. With this operation, the sheet conveyed into the second switchback convey path 54, with the leading end thereof traveling first, branches off to the second discharge path 62 by the switching pawl 63. In this manner, sheets are sequentially discharged onto the second discharge tray 69 through the third convey rollers 67 and the second discharge rollers 68 with the image-bearing surfaces facing up.

As described above, according to the switching gate 52 of the present invention, when sheets conveyed into the sheet discharge processing device 5 are to be discharged onto the first discharge tray 66 with the image-bearing surfaces facing down, a sheet can be conveyed into the switchback convey path at the same timing when another sheet which has been conveyed into the switchback convey path is discharged. For this reason, the sheet convey cycle can be shortened. Even if, therefore, an image forming operation is performed at a higher speed, sheets can be properly discharged after they are reversed and conveyed.

The switching gate 52 is rotatable. The straight guide path 521 and the first and second reverse guide paths 522, 523 are defined by the four guide plates 525*a* to 525*d* of the switching gate 52 to ensure paths each for guiding the upper and lower surfaces of a sheet to convey it to the first or second switchback convey path 53 or 54 upon rotation of the switching gate 52. With this structure, the switching gate 52 can be rotated without retracting the guide plates to ensure a path or guiding a sheet by only one guide surface, unlike the conventional structure. This simplifies the driving operation of the switching gate 52, and allows reliable guidance of a sheet, thereby preventing a conveyance failure.

In this case, since the guide paths 521, 522, and 523 are defined by the guide plates 525*a* to 525*d* as described above, the switching gate 52 can reliably guide a sheet received in one of the guide paths to the first or second switchback convey path 53 or 54. Since the two ends of each of the guide plates 525*a* to 525*d* are fixed to the side plates 54, the switching gate 52 can be rotated with a simple switching mechanism without retracting the guides defining the respective convey paths. In addition, this switching operation can be reliably and stably performed.

However, when the switching gate 52 rotates, a slight discontinuous portion is inevitably formed between the inlet 50 and each of the guide paths 521, 522, and 523. For this reason, the leading end of a sheet might be caught in this discontinuous portion to cause a jam or conveyance failure.

Figure 9:
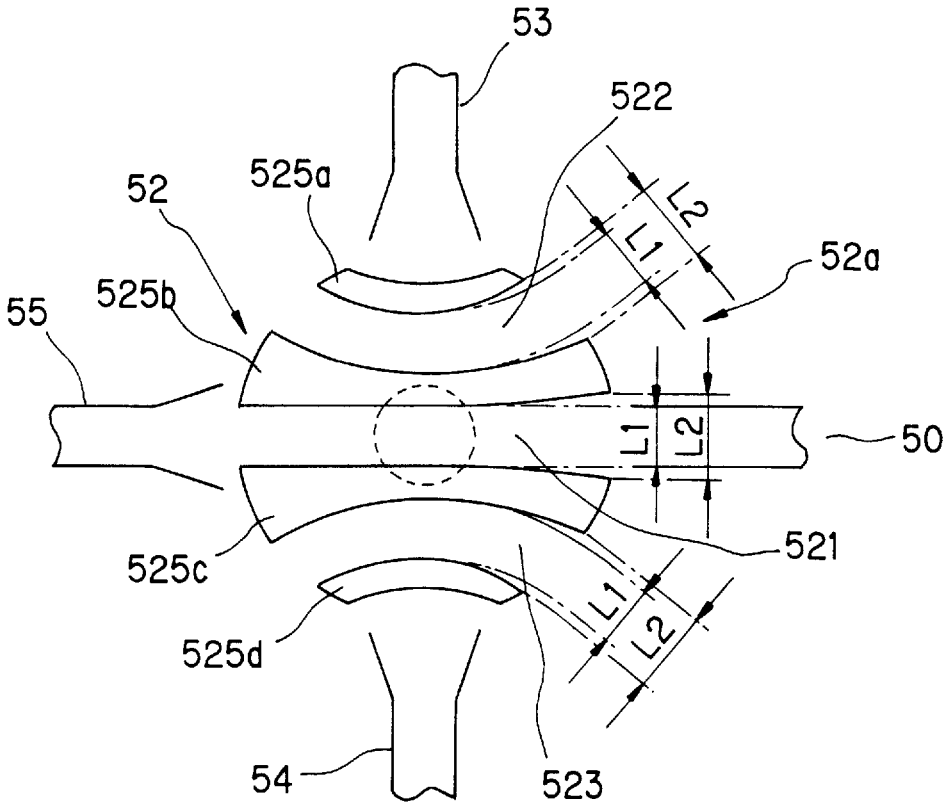
FIG. 9 is a longitudinal sectional view showing an example of the shape of each guide path of a switching gate according to the present invention.

In order to solve this problem, a switching gate 52*a* may be formed, as shown in FIG. 9. More specifically, the entrance (through which a sheet is received) of each of the guide paths 521, 522, and 523 arranged in the switching gate 52*a* to guide sheets is set to be wider than the exit (through which a sheet is discharged) of each guide path. Letting L2 be the width of the entrance (the width in a direction perpendicular to the upper and lower surfaces of a conveyed sheet), and L1 be the width of the exit, L2>L1 is set. The difference between the width L2 and the width L1 is 1 mm or more and 5 mm or less. In this case, the upper limit is set to be 5 mm so as to prevent an increase in the size of the switching gate 52*a*. As the switching gate 52*a* increases in size, the length of each guide path formed therein increases, and hence the probability of a conveyance failure in each path increases.

For this reason, the width L2 is preferably larger than the width L1 by about 2 mm. The width L1 is preferably set to be almost equal to the width of the convey path on the inlet 50 side. Therefore, the width L2 is preferably set to be larger than the width L1 by about 2 mm.

With the above arrangement, the curl of a sheet which is formed when the sheet passes through the fixing unit on the copying machine body 1 side, i.e., the fixing rollers 36, does not cause a conveyance error of the sheet at the coupling portion of the switching gate 52*a*, e.g., being caught on the coupling portion. The sheet can therefore be guided stably. The same effect can also be obtained when sheets are conveyed from the switchback convey paths 53 and 54 to the first and second reverse guide paths 522 and 523 of the switching gate 52*a*, thereby ensuring reliability in sheet transfer.

Tables 1 and 2 show the conveyed states in consideration of the relationship between the conveying force, i.e., the pressing force, of the convey rollers 56 (or 59) and the diameter of the storing section 58 (or 61). More specifically, in Tables 1 and 2, "o" indicates that a sheet can be properly conveyed, "Δ" indicates that a sheet can be conveyed with less stability but with no practical problem, and "x" indicates that a conveyance failure occurs.

TABLE 1

[A3 size]

| Conveying | Diameter = 60 mm | | | Diameter = 50 mm | | | Diameter = 40 mm | | |
|---|---|---|---|---|---|---|---|---|---|
| Force (g) | 52 g/m$^2$ Sheet | 64 g/m$^2$ Sheet | 128 g/m$^2$ Sheet | 52 g/m$^2$ Sheet | 64 g/m$^2$ Sheet | 128 g/m$^2$ Sheet | 52 g/m$^2$ Sheet | 64 g/m$^2$ Sheet | 128 g/m$^2$ Sheet |
| 200 | o | x | x | o | x | x | x | x | x |
| 400 | o | x | x | o | x | x | x | x | x |
| 600 | o | o | x | o | o | x | x | x | x |
| 800 | o | o | Δ | o | o | x | x | x | x |
| 1,000 | o | o | o | o | o | x | x | x | x |
| 1,200 | o | o | o | o | o | Δ | x | x | x |
| 1,400 | o | o | o | o | o | o | Δ | x | x |
| 1,600 | o | o | o | o | o | o | o | Δ | x |

TABLE 2

[A4 size]

| Conveying | Diameter = 60 mm | | | Diameter = 50 mm | | | Diameter = 40 mm | | |
|---|---|---|---|---|---|---|---|---|---|
| Force (g) | 52 g/m$^2$ Sheet | 64 g/m$^2$ Sheet | 128 g/m$^2$ Sheet | 52 g/m$^2$ Sheet | 64 g/m$^2$ Sheet | 128 g/m$^2$ Sheet | 52 g/m$^2$ Sheet | 64 g/m$^2$ Sheet | 128 g/m$^2$ Sheet |
| 200 | o | Δ | x | o | Δ | x | x | x | x |
| 400 | o | o | Δ | o | o | Δ | x | x | x |
| 600 | o | o | o | o | o | o | x | x | x |
| 800 | o | o | o | o | o | o | x | x | x |
| 1,000 | o | o | o | o | o | o | x | x | x |
| 1,200 | o | o | o | o | o | o | Δ | x | x |
| 1,400 | o | o | o | o | o | o | o | Δ | x |
| 1,600 | o | o | o | o | o | o | o | o | Δ |

The above description concerns the operation of the sheet discharge processing device 5 in accordance with each operation mode in image formation in the copying machine body 1.

The loop-like storing sections 58 and 61 arranged on the downstream sides of the switchback convey paths 53 and 54, and the first and second convey rollers 56 and 59 arranged in the switchback convey paths 53 and 54, which are used to reverse a sheet in the present invention, will be described next. The object of this arrangement is to reduce the size of the sheet discharge processing device 5 of the present invention.

There are many types of sheets which differ in thickness, elasticity, coefficient of friction, surface properties, and the like. Various problems are therefore posed in conveyance of sheets alone, e.g., the frictional resistance between the sheet and the convey guide surface, and the frictional resistance between sheets.

Tables 1 and 2 show the conveyed states with respect to the types of sheets, i.e., the thicknesses of sheets. The conveying force of the convey rollers 56 (or 59) in FIGS. 10 and 11 and the conveyed states of sheets P are evaluated, in particular.

According to the experiment results, when the inner diameter of the storing section 58 (or 61) is 40 mm, the resistance produced upon conveyance of a sheet into the loop increases because of the small diameter, requiring a large conveying force. This conveying force is proportional to the thickness of the sheet P.

Figure 10:
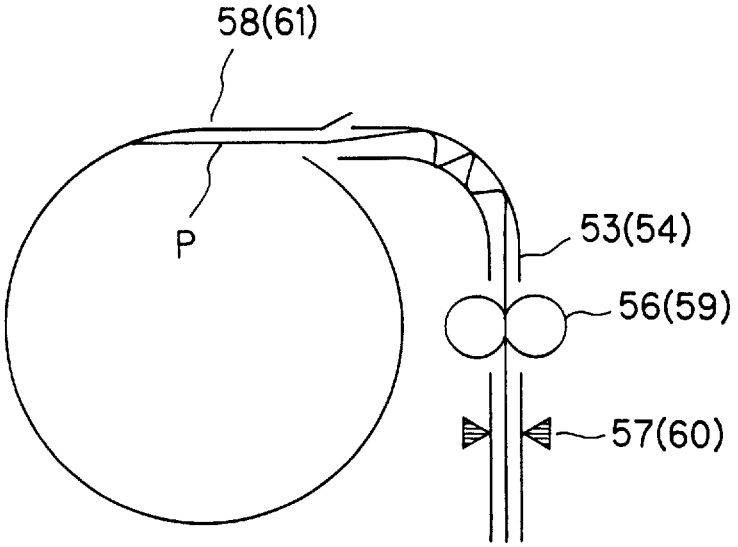
FIG. 10 is a sectional view showing the jammed state of a sheet at a loop-like guide portion formed on the downstream side of a switchback convey path of the sheet discharge processing device of the present invention.

As shown in Tables 1 and 2, as the conveying force of the convey rollers 56 (or 59) increases, the pressing force between the rollers increases. If, however, the pressing force excessively increases, the sheet bends. This may cause a sheet jam, as shown in FIG. 10. In addition, as the pressing force increases, the torque of the motor for driving the convey rollers 56 (or 59) must be increased. That is, a large motor is required, which is disadvantageous in terms of cost.

Assume that the inner diameter of the storing section 58 (or 61) is set to be 50 mm or more. In this case, when the conveying force, i.e., the pressing force is set to 1.4 kg or more, 52 to 128 g/m$^2$ sheets P can be conveyed into a guide member 58*a* (or 61*a*) of the loop-like storing section 58 (or 61) without posing any problem. In general, as standard sheets, sheets having weights near 64 g/m$^2$ are often used. By setting the conveying force to, e.g., about 600 g, in accordance with such a sheet, the sheet can be conveyed into the storing section 58 (or 61) against the frictional resistance between the sheet and the guide member 58*a* (or 61*a*) without slipping.

In designing a device on the basis of the above data, the conveying force may be set with reference to 600 g as a conveying force that can guarantee conveyance of a standard sheet. That is, the conveying force is set depending on the weight of a sheet which is to be conveyed without failure, in comparison with the standard sheet. If a conveying force up to about 1,600 g is set, even thick sheets can be properly conveyed without excessively increasing the torque of the driving motor.

As is apparent from the above Tables, when the diameter of the loop-like guide member portion is set to 40 mm, since the loop of a sheet decreases in size, the conveyed state of the sheet becomes unstable. When the diameter of the guide member portion is set to 50 mm or more, the conveyed state of a sheet is stable. However, the diameter of the circular portion of the storing section 58 (or 61) cannot merely be increased. That is, as the diameter increases, the overall size of the sheet discharge processing device 5 increases, resulting in a wasteful space. If the maximum size of the sheet P which can be processed by the image forming apparatus is A3 size, it suffices to set at least a diameter large enough to prevent a sheet from being wound doubly. For example, since the longitudinal dimension or length of a A3-size sheet is about 420 mm, the diameter of the storing section 58 (or 61) may be set to about 134 mm. In addition, in consideration of the distance between the first convey rollers 56 and the first storing section 58, the diameter may be set to 130 mm or less. The upper limit of the diameter can be determined in accordance with a sheet of the maximum size. As the size of a sheet to be processed decreases, a smaller device can be realized.

If the proportion of the sheet reversing portion to the sheet discharge processing device 5 is to be decreased to realize a smaller device, the diameter of the first storing section 58 is preferably set near 50 mm.

Figure 11:
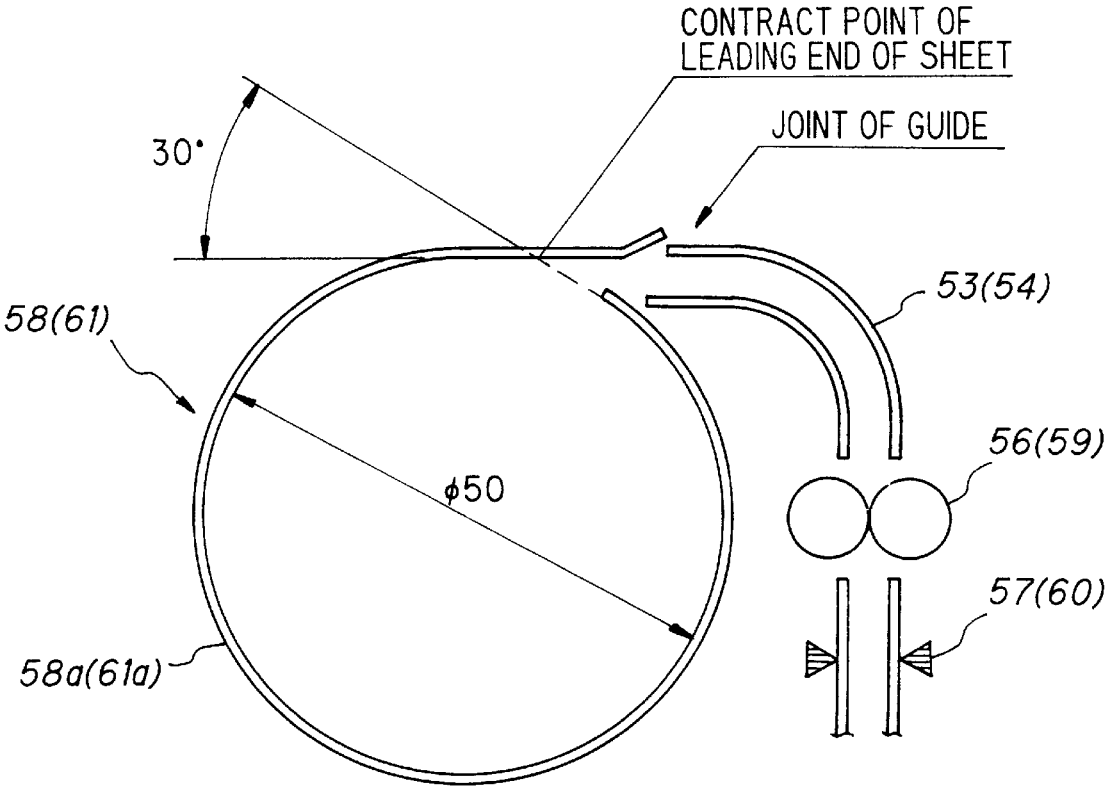
FIG. 11 is a longitudinal sectional view showing an example of the shape of the loop-like guide portion formed on the downstream side of a switchback convey path of the sheet discharge processing device of the present invention.

In addition, the conveyed state of the sheet P is stabilized by properly defining the angle at which the leading end of the sheet P, which is guided by the loop-like guide member 58*a* (or 61*a*) of the storing section 58 (or 61) to be looped, comes into contact with the inner surface of the sheet P during conveyance, as shown in FIG. 11. According to experiment results, 30° or less is proper as the angle at which the leading end of a sheet comes into contact with the surface of the sheet during conveyance on the surface of the loop-like guide member 58*a* (or 61*a*). Beyond this angle, the possibility of a jam increases because of the collision of the leading end of the sheet.

In this case, the above angle is the angle defined by the extended line of a sheet which is guided along the inner surface of the guide member 58*a* (or 61*a*) of the storing section 58 (or 61) and further guided from the terminal end of the guide member 58*a* (or 61*a*) to come into contact with the guide member 58*a* (or 61*a*) at the point defined as a re-contact point of the leading end of the sheet, and the tangent direction at the re-contact point.

Furthermore, the point of the loop-like guide member 58*a* (or 61*a*) at which the leading end of a sheet comes into contact with the surface of the sheet during conveyance is set in an area which does not overlap the joint of the loop-like guide member 58*a* (or 61*a*). With this arrangement, since the leading end of the sheet comes into contact with the inner surface of the guide member 58*a* (or 61*a*) while the sheet stably travels along the guide, no conveyance error occurs.

Figure 12:
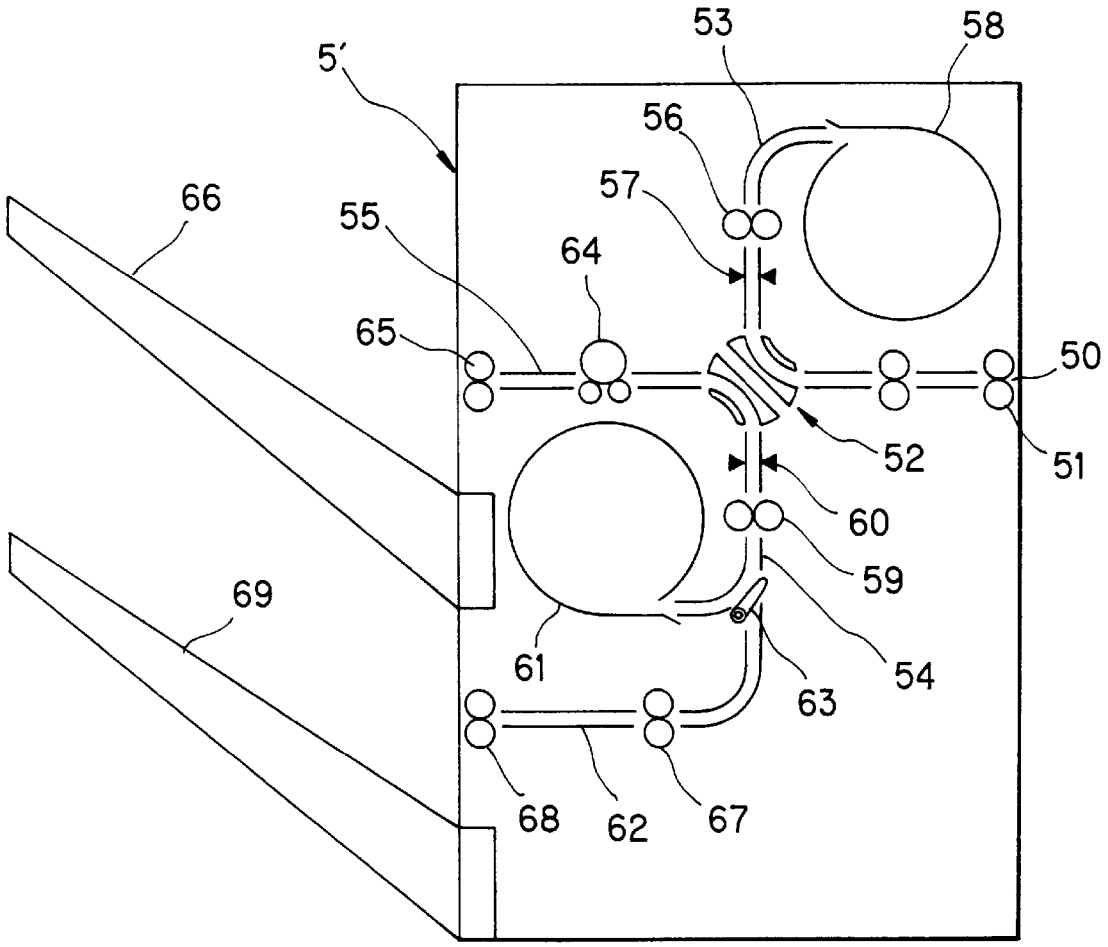
FIG. 12 is a front longitudinal sectional view showing the internal structure of a sheet discharge processing device according to another embodiment of the present invention.

FIG. 12 is a front longitudinal sectional view showing another embodiment of the sheet discharge processing device of the present invention. The same reference numerals in this embodiment denote the same parts as in the above embodiment, and a description thereof will be omitted.

Referring to FIG. 12, a sheet discharge processing device 5' according to this embodiment is designed to stabilize the stacked state of discharged sheets in consideration of the curling tendency of each sheet itself. That is, in the embodiment, sheets to be discharged are made to curl in the same direction, and the sheets are discharged onto a first discharge tray 66 in the same state, thereby allowing a stable discharge operation.

In general, when a sheet is looped or bent in a convey path, the sheet has a curling tendency, resulting in a curl. Sheets tend to curl especially when they pass through the fixing rollers. For this reason, the sheets cannot be neatly stacked on the first discharge tray 66, but are disordered. That is, unless sheets curl in the same direction, an upper sheet may shift from a lower sheet, a discharged sheet may slip under a lower sheet, or the page order of image-formed sheets may be upset.

Curl removing rollers 64 are generally used to remove the curling tendency of a sheet before it is discharged onto the first discharge tray 66. The curling tendency of each sheet discharged onto the first discharge tray 66 is removed in this manner to realize a stable discharge operation. However, as in the present invention, sheets may have curling tendencies at the circular storing sections 58 and 61 arranged on first and second switchback convey paths 53 and 54. In the case shown in FIG. 1, sheets may have curling tendencies in opposite directions. For this reason, even if sheets pass through the curl removing rollers 64, they do not have curling tendencies in the same direction and are discharged in this state. As a result, the above problem may occur.

In order to solve the above problem, as shown in FIG. 12, the loop-like storing sections 58 and 61 of the switchback convey paths 53 and 54 are vertically and diagonally arranged on the two sides of the first discharge path 55 such that sheets can be discharged while they have curling tendencies in the same direction. Sheets are guided and conveyed into the storing sections 58 and 61 such that their image-bearing surfaces of the conveyed sheets face inward. Therefore, the sheets have curling tendencies in the same direction. When these sheets pass through the curl removing rollers 64, the curls in the same direction are removed. Even if sheets have curls, the sheets are sequentially discharged onto the first discharge tray 66 with the curls in the same direction. With this operation, the order of discharged sheets is not upset, and a pile of stacked sheets does not collapse, thus realizing a stable discharge operation.

The present invention is not limited to the structure shown in FIG. 12. For example, the curling directions of the upper and lower storing sections 58 and 61 may be reversed.

Some consideration is given to prevent a sheet P from having a curling tendency in the structure shown in FIG. 1 as well as in the structure shown in FIG. 12. That is, the curling directions of the loop-like first and second storing sections 58 and 61 of the first and second switchback convey paths 53 and 54 are opposite to the directions in which sheets are bent by the first and second reverse guide paths 522 and 523. Even if, therefore, sheets have curling tendencies, when they pass through the respective loop-like guide paths, the curling tendencies are removed or sheets have curling tendencies in the same direction after they are discharged from the guide paths.

FIGS. 13 to 16 are perspective views showing various embodiments of the guide members 58*a* (or 61*a*) of the storing section 58 (or 61).

Figure 13:
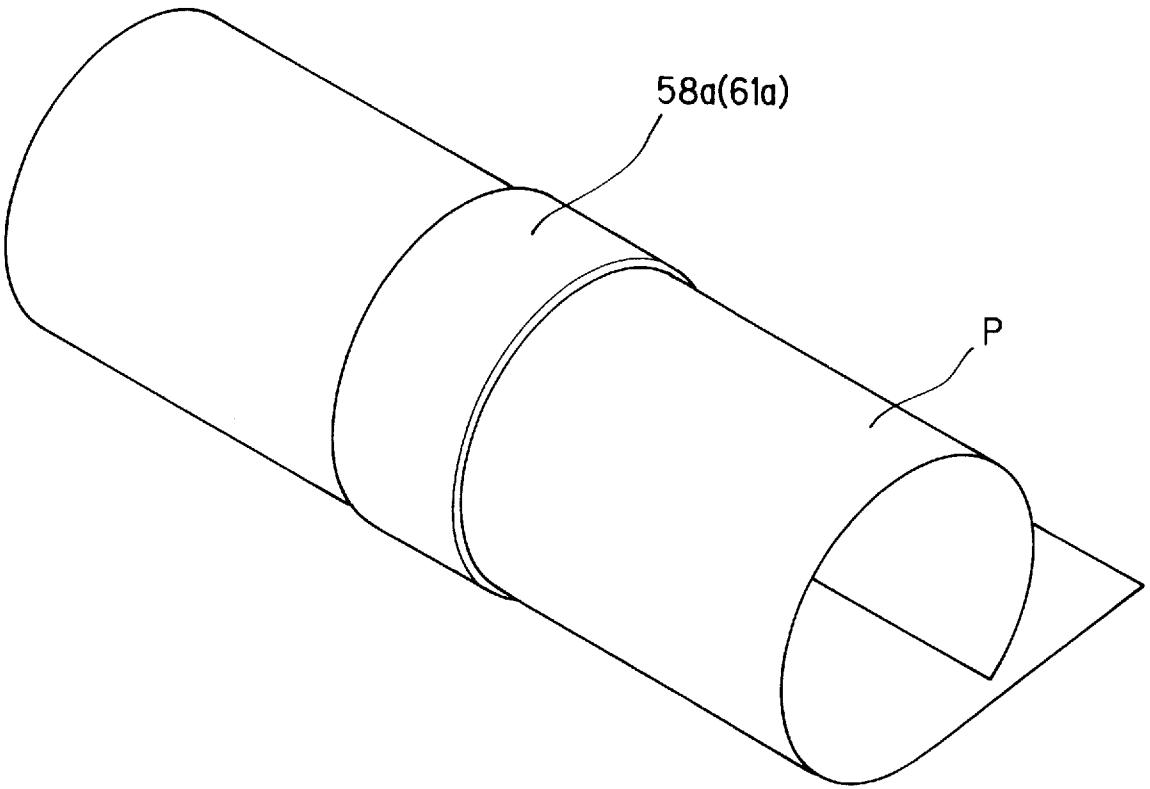
FIG. 13 is a perspective view showing an embodiment of a guide member as a part of a loop-like storing section.

FIG. 13 shows a structure in which a loop-like guide member 58*a* (or 61*a*) as a part of the storing section 58 (61) is placed in correspondence with the central portion of a sheet P. If the sheet P is conveyed into the loop-like guide surface (inner surface) while the sheet is supported throughout the width in a direction perpendicular to the convey direction, a force that pushes back the sheet P acts thereon because of the elasticity and stiffness of the sheet P. The two end portions of the sheet P tend to bend particularly. If a sheet P is conveyed in a bent state, portions of the sheet P between its central portion and the two end portions wave, resulting in a sheet jam. If the guide member 58*a* (or 61*a*) is designed to support the entire surface of the sheet P, the frictional resistance between the sheet P and the guide member greatly increases.

In the present invention, therefore, the guide member 58*a* (or 61*a*) for guiding the sheet P in the form of a loop is placed at a position near the central portion of the sheet P in the convey direction, as shown in FIG. 13. With this structure, the sheet P can be guided in a more stable state to the storing section 58 (or 61).

Figure 14:
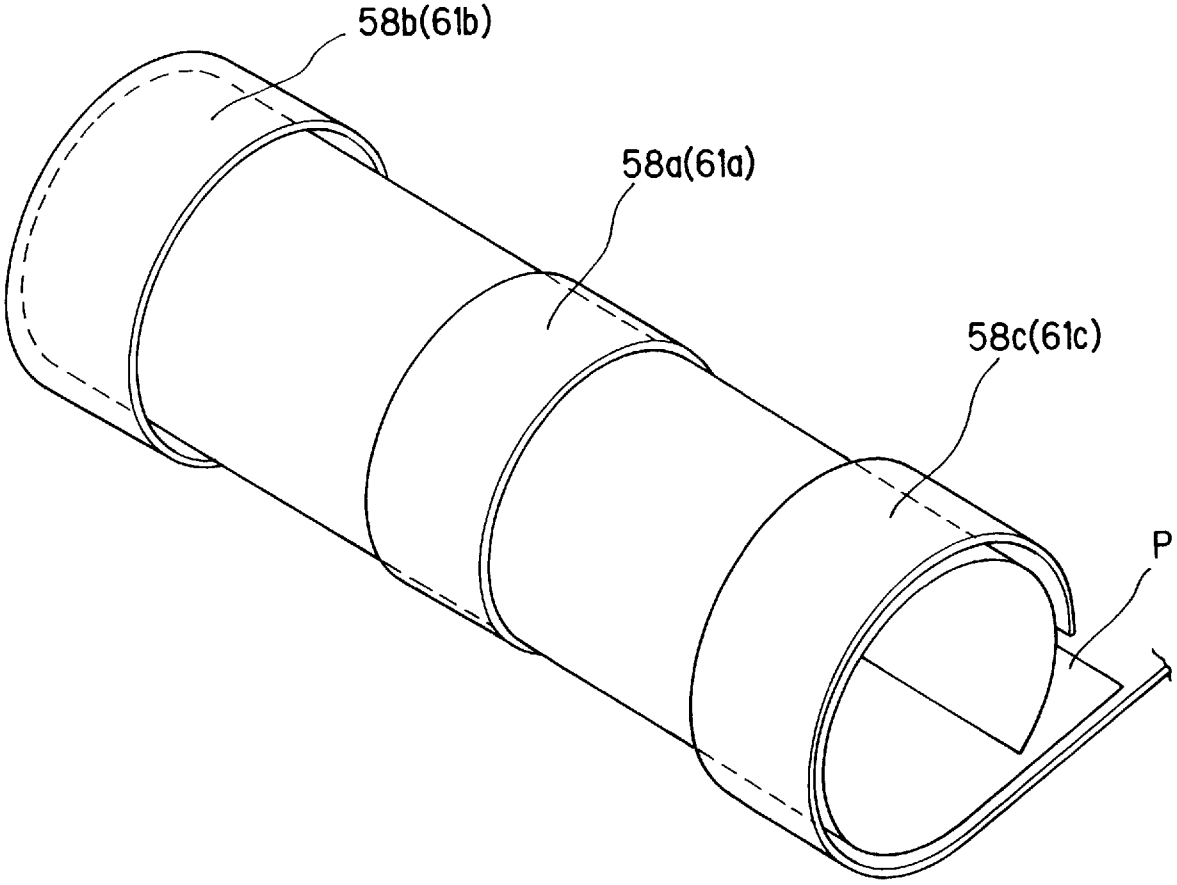
FIG. 14 is a perspective view showing another embodiment of a guide member as a part of a loop-like storing section.

FIG. 14 shows a structure in which loop-like auxiliary guide members 58*b* and 58*c* (or 61*b* and 61*c*) for supporting the two end portions of a sheet-P are added to the loop-like guide member 58*a* (or 61*a*) in the structure shown in FIG. 13. The diameter of each of these auxiliary guide members 58*b* and 58*c* is set to be slightly larger than the diameter of the guide member 58*a* (or 61*a*). For example, the diameter of each auxiliary guide member is larger than that of the guide member by about 1 to 2 mm.

This structure is designed to prevent the two end portions of a sheet from greatly bending so as not to cause a sheet jam, since the two end portions of a sheet tend to bend, as described with reference to the guide member 58*a* (or 61*a*) constituting the storing section 58 (or 61) in FIG. 12. Further, this structure is to ensure to guide the two end portions of the sheet.

Figure 15:
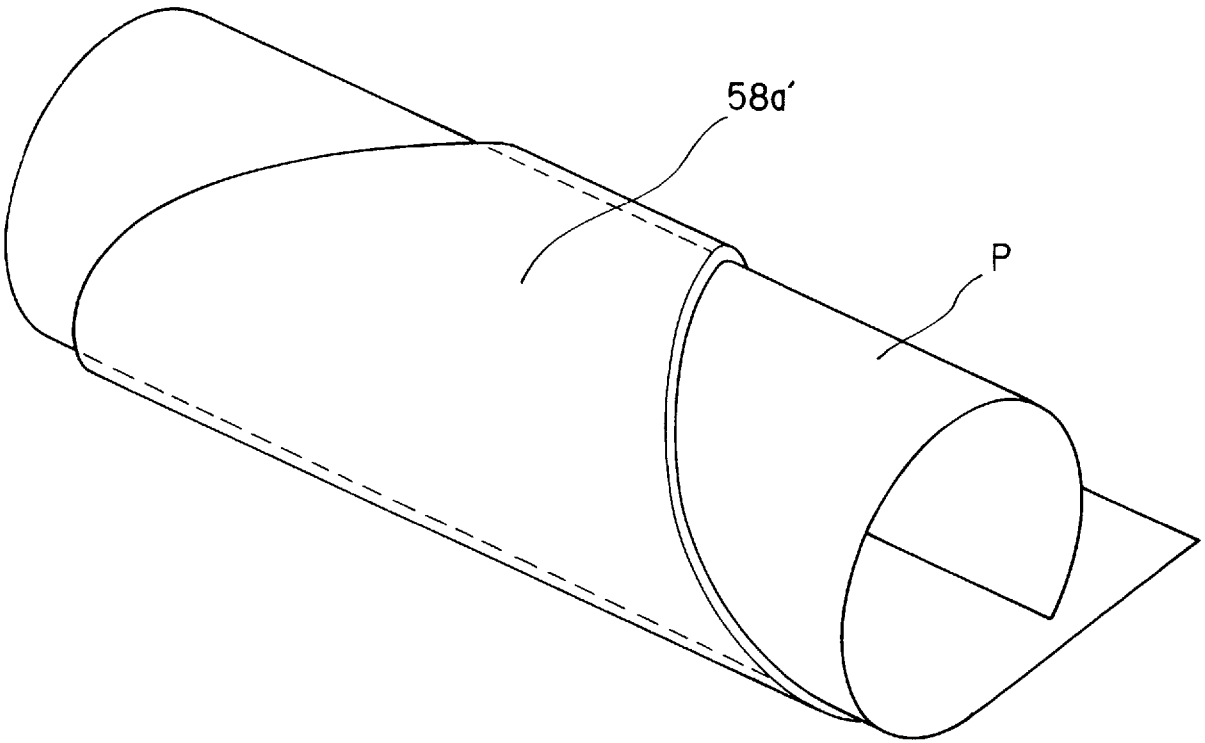
FIG. 15 is a perspective view showing still another embodiment of a guide member as a part of a loop-like storing section.

FIG. 15 shows still another embodiment of the loop-like guide member as a part of the storing section 58 (or 61), in which a loop-like guide member 58*a*' (or 61*a*') which gradually tapers narrower toward the downstream side in the guiding direction, as shown in FIG. 15. This structure is obtained in consideration of the friction between the loop-like guide member 58*a*' (or 61*a*') and the sheet P to be guided/conveyed by the guide member. That is, the frictional resistance is gradually decreased along the inner surface of the loop-like guide member 58*a*' (or 61*a*') to allow smooth conveyance of the sheet P. With this structure as well, the two end portions of the sheet P can be guided more reliably.

Figure 16:
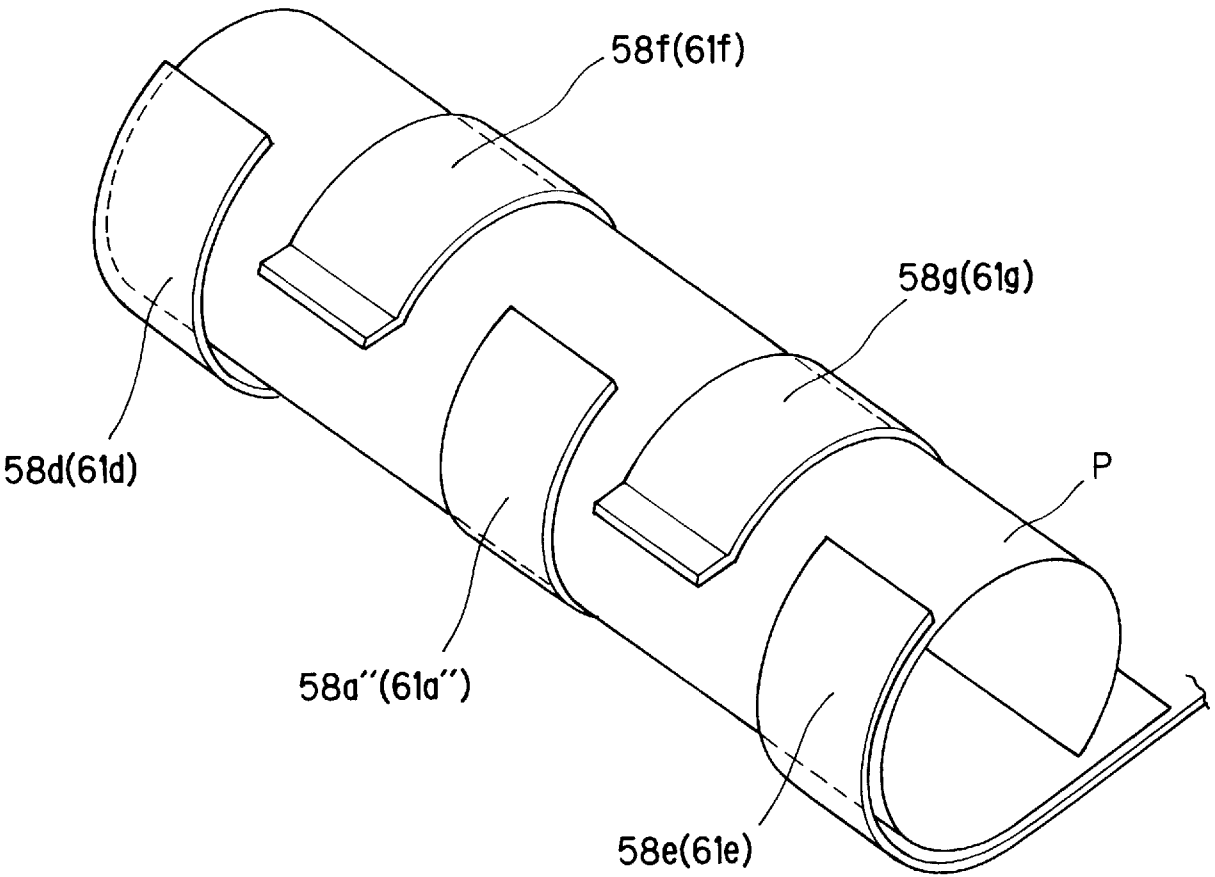
FIG. 16 is a perspective view showing still another embodiment of a guide member as a part of a loop-like storing section.

FIG. 16 shows still another embodiment of the loop-like guide member, in which a first guide portion of a loop-like guide portion is constituted by a guide member 58*a*" (or 61*a*") for guiding a portion near the central portion of a sheet P and guide members 58*d* and 58*e* (or 61*d* and 61*e*) for guiding the two end portions of the sheet P. The diameter of each of the guide members 58*d* and 58*e* is set to be slightly larger than the guide member 58*a*". In addition, guide members 58*f* and 58*g* (or 61*f* and 61*g*), each having a diameter near the diameter of the guide member 58*a*" (or 61*a*" ) at the central portion, are arranged on the downstream side. With this structure, a sheet discharge processing device including almost all the guide structures and the effects obtained by the respective guides described with reference to FIGS. 13 to 15 can be realized.

The respective embodiments of the storing sections 58 (or 61) constituted by the loop-like guide members 58*a* to 58*a*" (or 61*a* to 61*a*" ) have been described. Each embodiment is designed to minimize the frictional resistance at a portion where a sheet comes into contact with the inner surface of each guide member so as to smoothly guide/convey the sheet. Each of the guide members 58*a* to 58*a*" (or 61*a* to 61*a*" ) as part of the storing section 58 (or 61) is placed only outside the guide path for guiding a sheet. A sheet can therefore be guided more stably by the guide member having the above structure.

An embodiment of the control operation of the sheet discharge processing device 5 of the present invention will be described finally with reference to the flow chart of FIG. 17. The following control operation for a sheet discharge operation is performed to reliably perform the switching operation of the switching gate 52 at a proper timing so as to prevent damage to the trailing end of a sheet and the switching gate 52. In addition, this control operation is performed to execute discharge processing in the shortest sheet convey cycle. Furthermore, the following control operation is performed by the sorter control unit 76 of the sheet discharge processing device 5 described with reference to FIG. 5.

Figure 17:
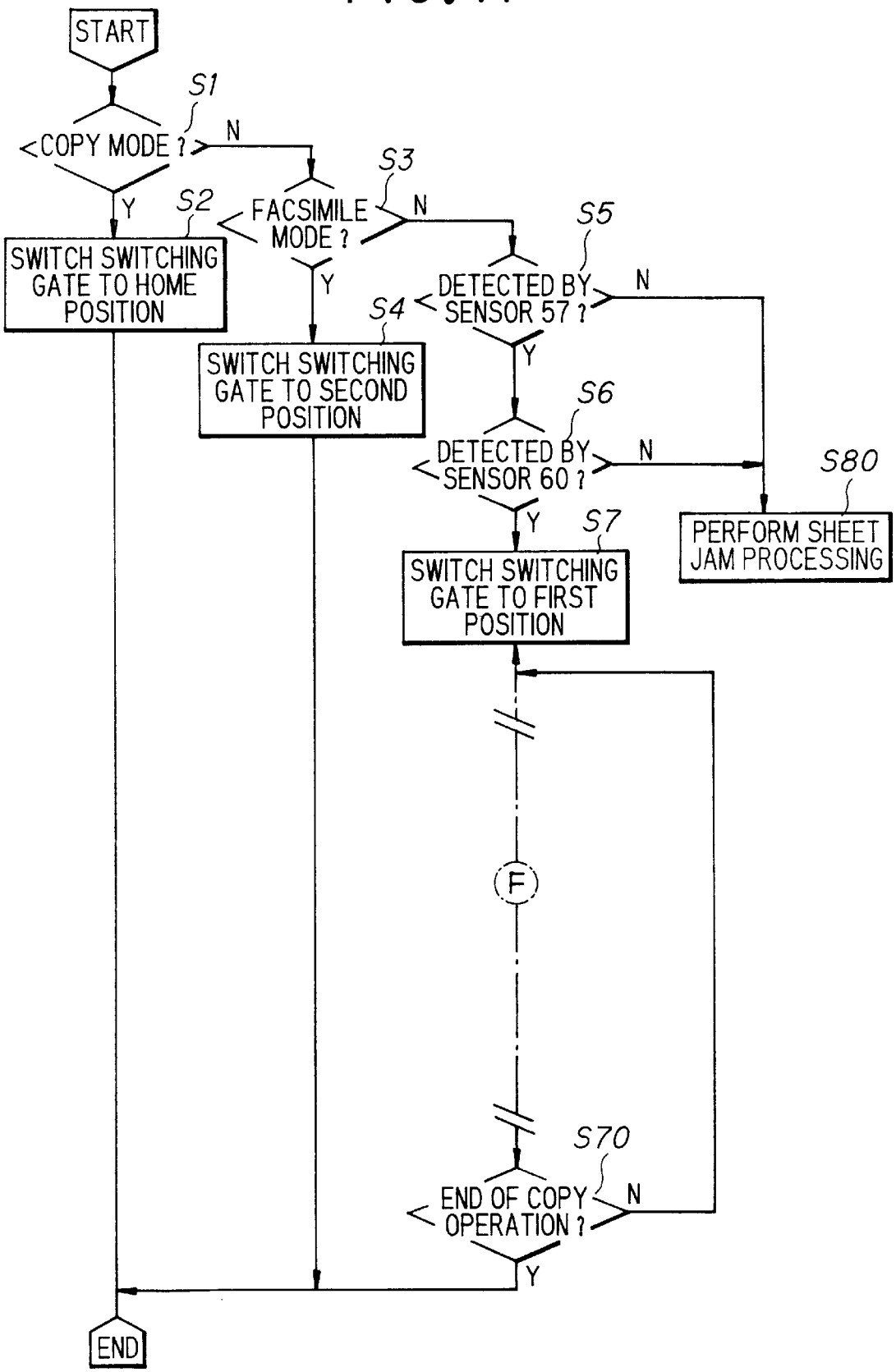
FIG. 17 is a flow chart for explaining an example of the control operation of the sheet discharge processing device of the present invention.

Referring to FIG. 17, when a sheet discharged from the copying machine body 1 side is conveyed to the inlet 50, the operation state of the digital copying machine body 1 is checked. That is, it is checked whether the general copy mode is set (S1). If the copy mode is determined (YES in S1), the position of the switching gate 52 is switched to the home position in FIG. 1 (S2). In this case, when the power supply is turned on, the digital copying machine body 1 is initially set in the general copy mode. When the digital copying machine body 1 is to operate as a facsimile apparatus, this apparatus is connected to a facsimile apparatus at the destination via a telephone line. When transmission can be performed, the apparatus is set in the facsimile mode.

In the copy mode, a sheet is discharged onto the first discharge tray 66 via the straight guide path 521 of the switching gate 52 with the image-bearing surface facing up.

If it is determined that the copy mode is not set (NO in S1), the flow advances to step 3 (S3) to check whether the digital copying machine body 1 is set in the facsimile mode. If it is determined that the facsimile mode is set (YES in S3), the switching gate 52 is switched to the state in FIG. 8 (S4) to guide the sheet into the second reverse guide path 523 of the switching gate 52. The switching pawl 63 is then switched to the second discharge path 62 side to guide the sheet onto the second discharge tray 69.

If it is determined in step 3 (S3) that the facsimile mode is not set either (NO in S3), it indicates that the printer mode is set. In this case, this apparatus performs image formation based on print image data sent from other apparatuses such as a wordprocessor and a personal computer. The digital copying machine body 1 forms images on sheets in accordance with the sent image data. Such image data are generally sent in the page order. For this reason, in order to collate discharged sheets in the page order, the switching gate 52 is switched to the state shown in FIG. 7 or 8 first, and the states are sequentially switched every time a sheet is conveyed, thereby discharging the sheets onto the first discharge tray 66 with their image-bearing surfaces facing down.

Control in the printer mode will be described further in detail. A sheet P1 discharged from the digital copying machine body 1 side is conveyed to the inlet 50. The presence/absence of sheets in the first and second switchback convey paths 53 and 54 is checked by the detection sensors 57 and 60 (S5 and S6). This operation is performed to check the presence of a sheet in each switchback convey path. At first, sheets are present in neither convey paths, and one of them is selected. If the presence of a sheet is determined (NO in S5 or S6), jam processing is executed to notify the digital copying machine body 1 that the sheet discharge processing device 5 is in trouble (S80). With this operation, the digital copying machine body 1 stops an image forming operation until the trouble on the sheet discharge processing device 5 side is removed. After the trouble is removed, the presence of sheets is checked in steps 5 and 6 (S5 and S6) again.

Figure 18:
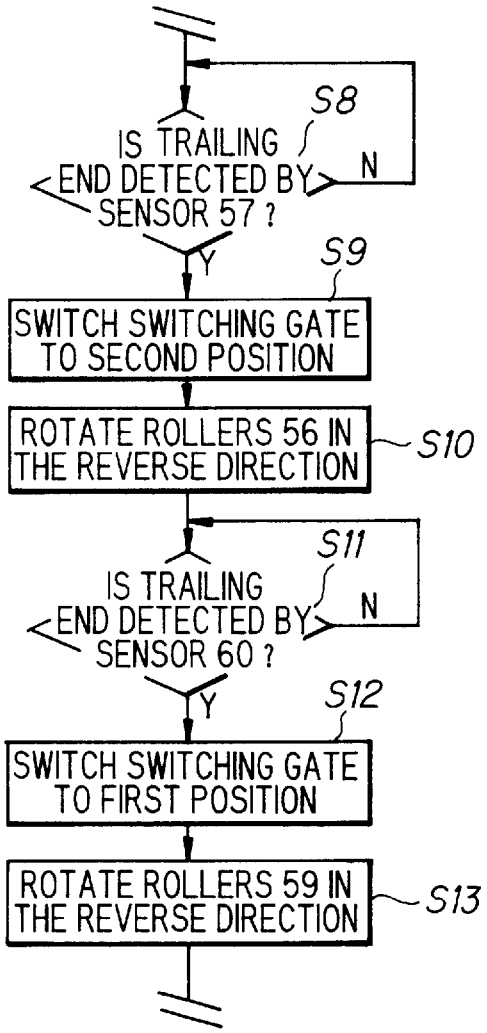
FIG. 18 is a flow chart for explaining another example of the control operation of the sheet discharge processing device in FIG. 17.

Assume that if it is determined that no abnormality has occurred on the sheet discharge processing device 5 side (YES in S5 and S6), the first switchback convey path 53 is selected in this embodiment of the present invention, as described above. Reverse convey control based on this assumption will be described below. If it is determined in steps 5 and 6 (S5 and S6) that no abnormality has occurred (YES in S5 and S6), the switching gate 52 is switched to the state in FIG. 7, i.e., the first position, in step 7 (S7). The first sheet P1 having undergone image formation is conveyed into the first storing section 58 through the first reverse guide path 522 of the switching gate 52 and the first switchback convey path 53 by the first convey rollers 56 which are driven in the forward direction. Thereafter, control F is performed. FIG. 18 shows an example of this control F.

Referring to FIG. 18, while the sheet P1 is conveyed into the first switchback convey path 53, it is checked whether the trailing end of the sheet P1 is detected by the first detection sensor 57 (S8). If the trailing end is detected (YES in S8), the switching gate 52 is switched to the second position, i.e., from the state in FIG. 7 to the state in FIG. 8 (S9). The first convey rollers 56 are then driven in the reverse direction (S10) to convey the sheet P1, which has been conveyed into the first switchback convey path 53, to the discharge path 55. At this time, the switching gate 52 causes the discharge path 55 to communicate with the first switchback convey path 53 through the first reverse guide path 522.

The switching gate 52 causes the inlet 50 to communicate with the second switchback convey path 54 through the second reverse guide path 523. With this operation, a second sheet P2 is guided to the second switchback convey path 54 and conveyed into the second storing section 61 by the second convey rollers 59 which are driven to rotate in the forward direction. At the same time, the preceding sheet P1 in the first switchback convey path 53 is discharged onto the first discharge tray 66 through the discharge path 55.

In this operation, it is checked whether the trailing end of the sheet P2 is detected by the second detection sensor 60 of the second switchback convey path 54 (S11). If the trailing end of the sheet P2 is detected (YES in S11), the convey operation is completed, and the switching gate 52 is switched to the first position (S12), and the second convey rollers 59 are rotated in the reverse direction (S13). Before this operation is completed, the trailing end of the conveyed sheet (the trailing end in the convey direction, and the leading end of the sheet conveyed from the digital copying machine) is detected by the first detection sensor 57 on the first switchback convey path 53 side. At this time, the reverse rotation of the first convey rollers 56 is stopped, or the first convey rollers 56 are rotated in the forward direction.

If the trailing end of the sheet P2 is detected by the detection sensor 60 of the second switchback convey path 54 a predetermined period of time after the trailing end of the sheet P1 conveyed from the first switchback convey path 53 is detected by the first detection sensor 57, i.e., the trailing end of the sheet P1 passes through the first reverse guide path 522 of the switching gate 52, the switching gate 52 is switched, and the second convey rollers 59 are rotated in the reverse direction, as described above.

When the second sheet P2 which has been conveyed into the second switchback convey path 54 begins to be conveyed therefrom, the sheet P2 is discharged onto the first discharge tray 66 following the sheet P1. When a third sheet P3 is conveyed from the digital copying machine body 1, the sheet P3 begins to be conveyed into the first switchback convey path 53 by the first convey rollers 56. If it is determined in the flow chart in FIG. 17 that the copy operation is not completed (NO in S70), the operations in the flow chart in FIG. 18 are sequentially executed. By repeating the above operations, sheets sequentially conveyed from the digital copying machine body 1 are reversed and discharged onto the first discharge tray 66 to be stacked at this position.

Assume that the sheet discharge processing device 5 of the present invention is in the printer mode. In this case, by repeating the above control operation, image-formed sheets discharged from the digital copying machine body 1 are sequentially received from the first page, and all the copies can be discharged onto the first discharge tray 66 and collated with the image-bearing surfaces facing down. In addition, since a sheet conveyed through the switching gate 52 and a sheet conveyed into the switchback convey path in advance are conveyed at the same time, the sheet convey cycle can be shortened. Even if, therefore, the copy (print) speed of the digital copying machine increases, the sheet discharge processing device can satisfactorily cope with such an increase in copy speed.

Figure 19:
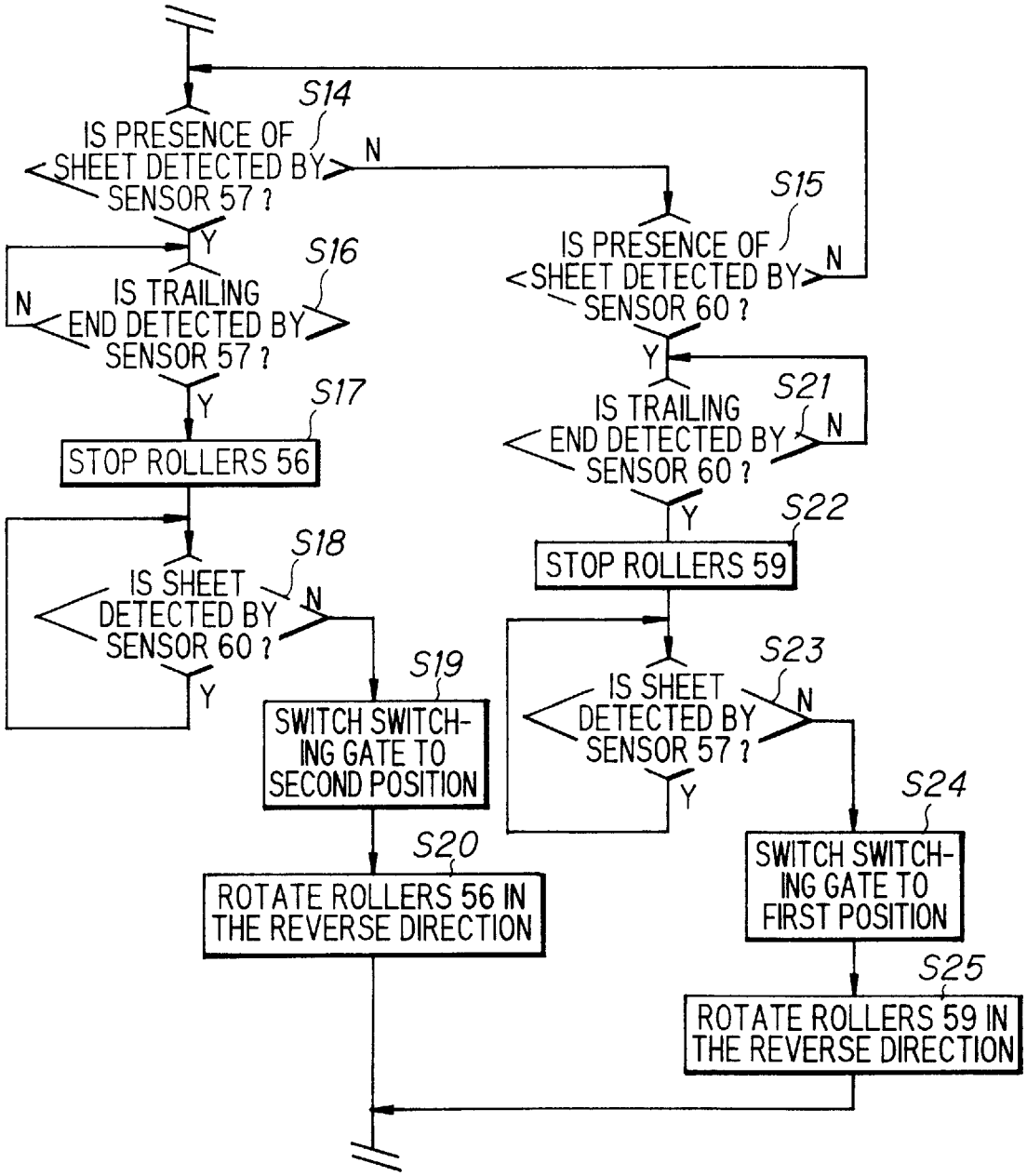
FIG. 19 is a flow chart for explaining still another example of the control operation of the sheet discharge processing device in FIG. 17.

FIG. 19 shows an example of sheet discharge processing control for image-formed sheets having different sizes. This example shown in FIG. 19 corresponds to control F in the flow chart of FIG. 17, and can be replaced with the flow chart in FIG. 18. In this case, image is formed on A3 and A4 sheets on the digital copying machine body 1 side.

When an image is formed on an A3 sheet first, the sheet is guided into one switchback convey path. If the A3 sheet is discharged from the switchback convey path in the process of guiding an A4 sheet into the other switchback convey path, since the A4 sheet is shorter than the A3 sheet, the A4 sheet is completely conveyed into the switchback convey path and preparation for reverse discharge processing is completed before the trailing end of the A3 sheet passes through the switching gate 52.

At this time, however, since the A3 sheet is being discharged, a discharge operation for the A4 sheet is suspended until the A3 sheet is completely discharged from the switchback convey path. Referring to FIG. 19, in conveying the A3 sheet into the first switchback convey path 53, it is checked whether the presence of a sheet is detected by the first detection sensor 57 (S14). If the present of a sheet is not detected (NO in S14), it is checked whether the presence of a sheet is detected by the second detection sensor 60 (S15). In this case, since the first switchback convey path 53 is selected at first, it is checked whether the presence of a sheet is detected by the first detection sensor 57. If it is determined that the presence of a sheet is detected, i.e., the detection sensor 57 is switched from the OFF state to the ON state (YES in S14), the first A3 sheet is conveyed into the first storing section 58 through the first switchback convey path 53 by the first convey rollers 56 which are rotated in the forward direction.

In this operation, if the trailing end of the sheet is detected by the first detection sensor 57 (switched from the ON state to the OFF state) (YES in S16), rotation of the first convey rollers 56 is stopped (S17), and the detection state of the second detection sensor 60 is checked (S18). That is, the presence/absence of a sheet conveyed from the second switchback convey path 54 is checked. As described above, this operation is performed to accurately switch the switching gate 52 by detecting the presence/absence of a sheet in the switchback convey path. If no sheet is detected by the second detection sensor 60 (NO in S18), the switching gate 52 is switched to the second position, i.e., the state shown in FIG. 8 (S19). The first convey rollers 56 are then rotated in the reverse direction (S20) to start discharging the A3 sheet conveyed into the first switchback convey path 53. At this time, although not shown, the second convey rollers 59 are rotated in the forward direction.

The flow then returns to the flow chart of FIG. 17 to check whether the copy operation is completed (S70). If the operation is not completed (NO in S70), the operation based on the flow chart of FIG. 19 is performed. In this case, since a sheet can be conveyed into the second switchback convey path 54, it is checked whether the presence of a sheet is detected by the second detection sensor 60 (S15). If the presence of a sheet is determined (YES in S15), it is checked whether the presence of a sheet is detected by the second detection sensor 60 (S21). If the trailing end of a sheet is detected (YES in S21), rotation of the second convey rollers 59 is stopped (S22), and the detection state of the first detection sensor 57 is checked to check the presence/absence of a sheet in the first switchback convey path 53 (S23).

Assume that the detected sheet is an A3 sheet. In this case, as described above, even if the trailing end of the A4 sheet is detected by the second detection sensor 60 (i.e., conveyance of the A4 sheet into the storing section 61 is completed), a discharge operation for the A4 sheet is temporarily set in the standby state. When the discharge operation for the sheet in the first switchback convey path 53 is continued, and the first detection sensor 57 detects that the sheet is discharged, i.e., the absence of a sheet (NO in S23), the switching gate 52 is switched (S24) and set to the first position in FIG. 7. The second convey rollers 59 are rotated in the reverse direction (S25). At the same time, the first convey rollers 56 are rotated in the forward direction.

With repetition of the above operation, when sheets having different sizes are processed, if the presence of a sheet conveyed from the other switchback convey path is detected, switching control of the switching gate 52 is performed. With this control operation, sheets can be properly fed and the switching gate 52 can be properly driven without causing a convey failure of a sheet and a rotation failure of the switching gate 52 owing to the trailing end portion of a sheet during conveyance.

While the trailing end of a sheet to be conveyed into one switchback convey path is detected, the sheet is temporarily put on standby. In this state, when the absence of a sheet in the other switchback convey path is detected, a discharge operation for the sheet on standby can be started. For this reason, even if sheets are conveyed and discharged at the same time, switching control of the switching gate 52 can be accurately performed at the timing when the trailing end of each sheet passes through the switching gate 52. Therefore, the above convey failure of a sheet and the above switching failure of the switching gate 52 do not occur.

In this case, switching control of the switching gate 52 is performed when the trailing ends of sheets are detected by the first and second detection sensors 57 and 60. Although not shown in any flow chart, for example, switching control of the switching gate 52 may be performed when a third detection sensor placed before the curl removing rollers 64 detects that the trailing end of a sheet passes through the reverse guide path of the switching gate 52. Alternatively, a timer is started when the detection sensor 57 or 60 detects the trailing end of a sheet, and switching control of the switching gate 52 is performed when the timer counts the time taken for the trailing end of the sheet to pass through the reverse guide path of the switching gate 52. In this case, the set time of the timer may be the time obtained by dividing the distance from the detection sensor 57 or 60 to the end point of the reverse guide path by the discharge/convey speed of a sheet, plus a time set in consideration of an error.

Another embodiment of sheet discharge processing control will be described. In general, the copying machine performs an image forming operation while always detecting the sizes of sheets sequentially conveyed through the convey path. Control is performed on the basis of detection of the sheet sizes. That is, in the process of feeding a sheet, the size of the sheet is detected. If, for example, a sheet is fed from the cassette paper feeder 34*a*, the size of each sheet stored in the cassette paper feeder 34*a* is detected in advance. When a sheet of this size is fed to undergo image formation, and the sheet is conveyed from the copying machine body 1 to the sheet discharge processing device 5 as described above, the size of the sheet can be detected on the sheet discharge processing device 5 side.

Another example of switching control of the switching gate 52 in the sheet discharge processing device will be described in detail below with reference to the flow chart of FIG. 20. As described above, the flow chart of FIG. 20 can be replaced with control F in FIG. 17.

When a first sheet is conveyed into the sheet discharge processing device, the first switchback convey path 53 communicates with the inlet 50, as described above. In this state, the sheet is conveyed into the first switchback convey path 53. The size of the sheet is detected before it is conveyed into the device. When the trailing end of the sheet is detected by the first detection sensor 57 (YES in S26), the rotation of the first convey rollers 56 is stopped, and preparation for a discharge operation for the preceding sheet is completed.

The flow waits until the timer means counts up to the time set in accordance with the size of the preceding sheet (S27). This time is based on the size of the preceding sheet, and the time required to complete a discharge operation of the preceding sheet, i.e., to completely discharge the sheet from the second switchback convey path 54 to the discharge path 55 (the time taken for the trailing end of the sheet to pass through the reverse guide path of the switching gate 52). In this case, since there is no preceding sheet, the set time is "0" at first. Count-up information is therefore immediately outputted from the timer (YES in S27), and the switching gate 52 is switched to the second position (S28). With this operation, the first switchback convey path 53 is caused to communicate with the discharge path 55, and the second switchback convey path 54 is caused to communicate with the inlet 50. In order to perform a discharge operation, the first convey rollers 56 are rotated in the reverse direction (S29). At the same time, the second convey rollers 59 on the second switchback convey path are rotated in the forward direction to convey the sheet therein.

After this operation, as described above, a time is set in the timer in accordance with the size of the preceding sheet to be discharged (S30). As described above, this time is based on the sheet size, and the time taken for the trailing end of the sheet to pass through the reverse guide path 522 or 523 of the switching gate 52. That is, the time of the timer is set in accordance with, for example, the dimension of A3, A4, B4, or B5 sheets in the longitudinal or lateral direction. For example, in feeding an A4 sheet in its longitudinal direction, the set time is equal to the sum of the time obtained by dividing the dimension of the sheet in the longitudinal direction (about 300 mm) by the convey speed, the time obtained by dividing the length of the convey path extending from the first or second detection sensor 57 or 60 to the end of the first or second reverse guide path 522 or 523 by the convey speed, and the time set in consideration of an error.

In the above state, while the next sheet is conveyed into the second switchback convey path 54, a discharge operation for the preceding sheet is being executed. If preparation for a discharge operation for the next sheet is completed, i.e., completion of conveyance of the sheet is detected by the detection sensor 60 (YES in S31), rotation of the second convey rollers 59 is stopped. When preparation for a discharge operation is completed, and the completion of the preparation is detected (the trailing end is detected), it is checked whether the time of the timer set in accordance with the size of the preceding sheet (S30) has been counted (S32). The timer means starts to count at the timing when reverse rotation of the convey rollers (e.g., 56) is started to start discharging the preceding sheet. If it is determined that the timer has counted up (YES in S32), the trailing end of a sheet to be discharged or conveyed is completely absent from the switching gate 52.

The switching gate 52 is switched to the first position (S33), and the second convey rollers 59 are rotated in the reverse direction (S34). At the same time, the first convey rollers 56 are rotated in the forward direction. At the same time, the time of the timer is set in accordance with the size of the preceding sheet to be discharged (S35). At this time, the timer starts to count. It is checked whether the copy operation is completed (S70). If the copy operation is not completed, the conveyed state of the sheet in the first switchback convey path 53 is detected by the detection sensor 57 again (S26), as shown in FIG. 20. The subsequent operations are the same as described above.

Assume that the discharge timing coincides with the convey timing. In this case, if the size of the preceding sheet is smaller than that of the succeeding sheet, the preceding sheet completely passes through the switching gate 52 at the timing when the succeeding sheet is conveyed into the switchback convey path, and preparation for a discharge operation is completed. As is apparent, at this timing, the set time of the timer has been counted. Therefore, the switching gate 52 is switched immediately when completion of conveyance of the succeeding sheet into the switchback convey path is detected.

If, however, the size of the succeeding sheet is smaller than that of the preceding sheet, a discharge operation for the preceding sheet is continued at the time when the succeeding sheet is completely conveyed into the switchback convey path, and preparation for a discharge operation is completed. At this continuation point, the counting operation of the timer is not completed in step 27 (S27) or 32 (S32). Therefore, when this counting operation is completed, switching control of the switching gate 52 can be reliably performed. This operation eliminates the possibility that the trailing end of a sheet is left in the switching gate 52 to cause a failure. Even if the discharge timing is different from the convey timing, the above control prevents the switching gate 52 from being switched while the trailing end of a sheet is left therein. In addition, even if sheets having various sizes are to be processed, switching control of the switching gate 52 can be performed without posing any problem. In addition, discharge processing can be performed with a shorter sheet convey cycle.

In the above case, in order to set the time of the timer, the size of a sheet is checked on the copying machine body side, and the time of the timer is set in accordance with the sheet size. However, the present invention is not limited to this. For example, the above time of the timer can be easily set by using the detection sensors 57 and 60. With this operation, even non-standard-size sheets can be easily processed as well as the above standard-size sheets.

Figure 20:
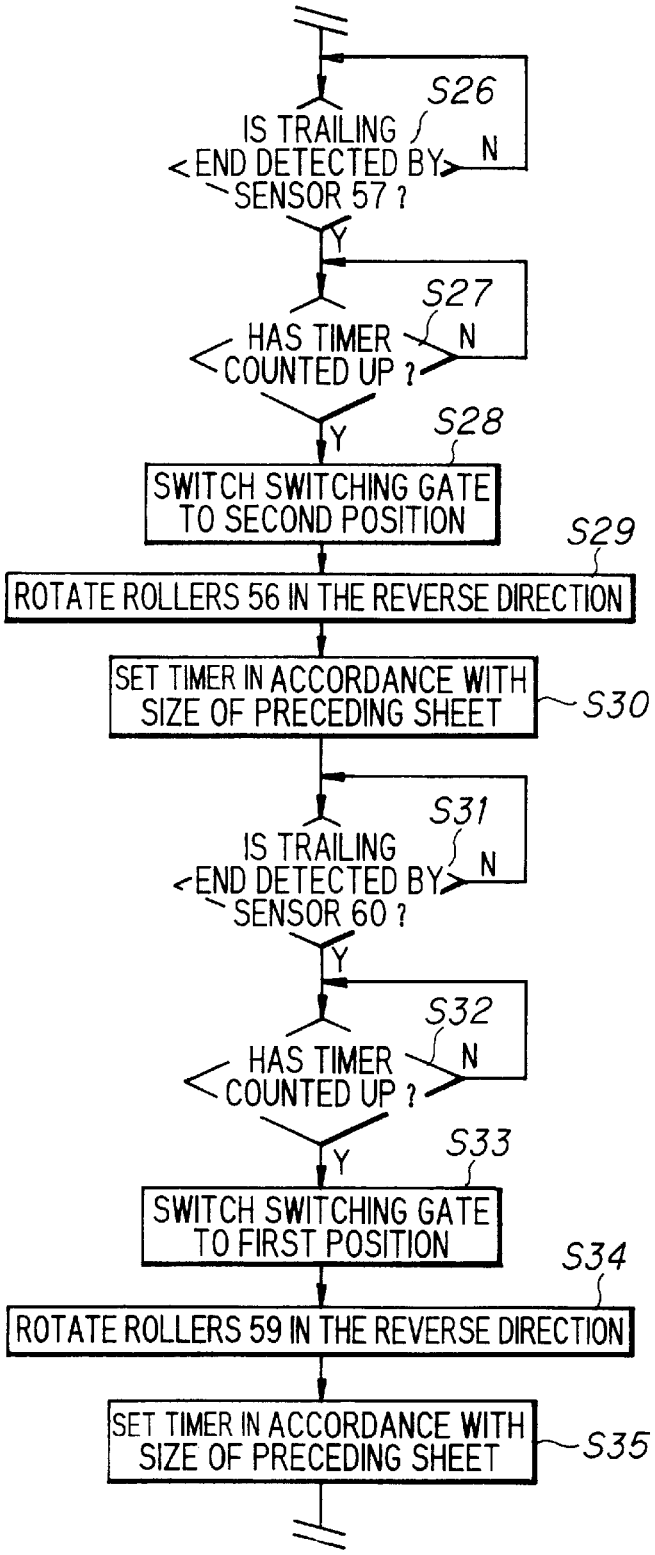
FIG. 20 is a flow chart for explaining still another example of the control operation of the sheet discharge processing device in FIG. 17.
Figure 21:
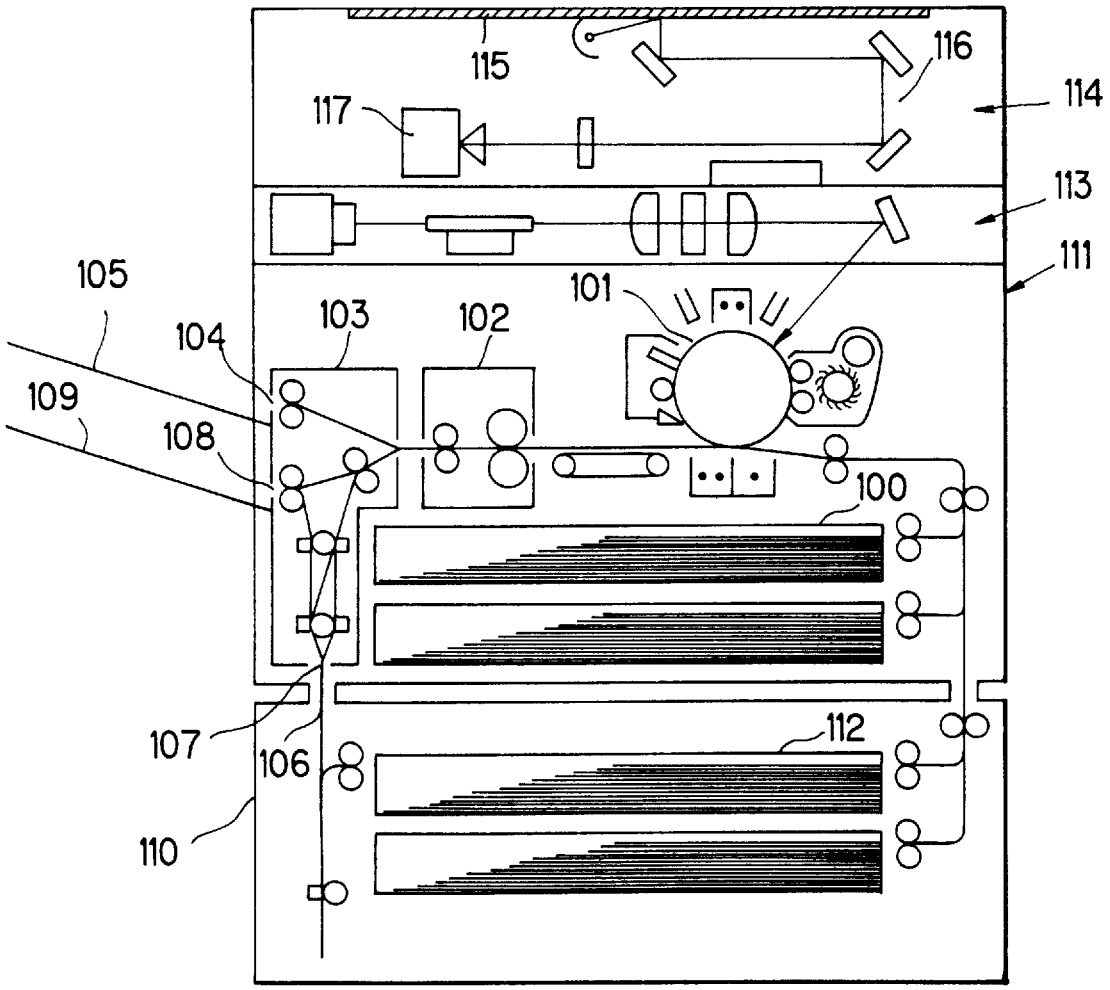
FIG.21 PRIOR ART
FIG. 21 is a longitudinal sectional view showing the overall structure of an image forming apparatus to explain a conventional sheet discharge processing device.
Figure 22A:
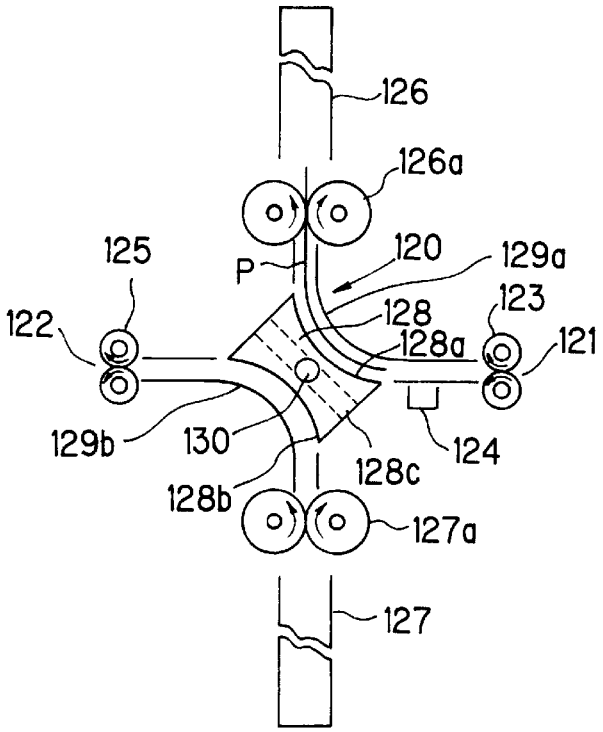
PRIOR ART FIG. 22A
FIGS. 22A and 22B show the structure of a conventional sheet discharge processing device.
Figure 22B:
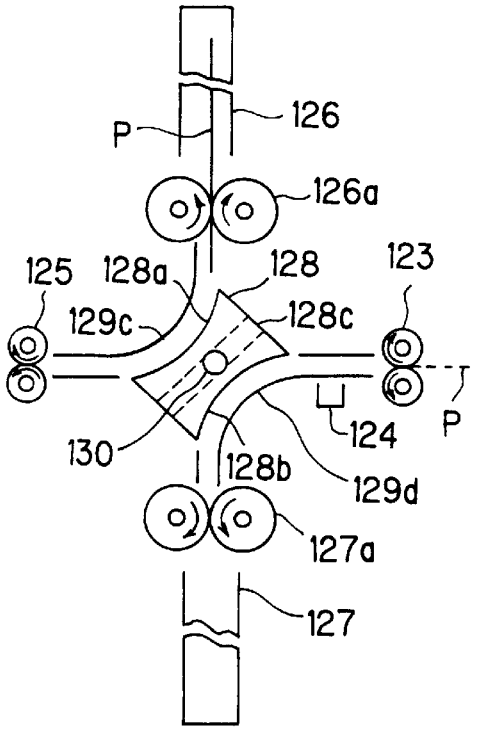

In addition to the processing in the flow chart of FIG. 20, when a sheet is conveyed into the switchback convey path 53 or 54, i.e., the leading end of the sheet is detected by the detection sensor 57 or 60, a time counting operation is started by using a counter. When the trailing end of the sheet is detected, the time counting operation of the counter is stopped. With this operation, the size of the conveyed sheet can be detected on the basis of the time counted by the counter. When a discharge operation is started, a time ts set in the timer means in steps 30 (S30) and 35 (S35) is set to a time (t1+t) obtained by adding a time t1 counted by the counter and the convey time (a constant time t) obtained by dividing the distance from the detection sensor 57 or 60 to the end of the reverse guide path of the switching gate 52 by the above convey speed.

With the above arrangement, since the time of the timer can be independently set on the sheet discharge processing device 5 side, the size information of a sheet need not be received from the copying machine body 1. For this reason, discharge and convey operations for sheets can be accurately detected in the sheet discharge processing device 5 to realize reliable switching control of the switching gate 52.

Abnormal processing control of the sheet discharge processing device of the present invention will be described below.

When a sheet convey abnormality occurs in the process of conveying or discharging a sheet in one of the switchback convey paths, a sheet stored and put on standby in the other switchback convey path is maintained in the same state, thereby preventing one sheet having undergone a copy operation from being wasted. In addition, since this switchback convey path is used, when a sheet convey abnormality occurs in one switchback convey path, as described above, the page order of image-formed sheets may be upset.

In particular, if a convey abnormality occurs in the process of discharging the preceding sheet, a convey operation on the sheet discharge processing device 5 side is stopped. In this case, the convey operation on the side where the convey abnormality is detected is stopped. If there is no abnormality in conveyance of a sheet into the other switchback convey path, this convey operation is continued. When the trailing end of the sheet is detected by the detection sensor, rotation of the convey rollers is stopped, and preparation for a discharge operation is completed.

When a sheet in a jammed state on the switchback convey path on the side where the convey abnormality has been detected is removed to eliminate the abnormality, information about this state is sent to the copying machine side. With this operation, the copying machine performs image formation corresponding to the convey abnormality again so as to skip succeeding image formation. Thereafter, succeeding image formation is performed. That is, the succeeding image-formed sheet is set in a standby state in one switchback convey path with preparation for a discharge operation being completed, and this image-formed sheet is caused to skip the succeeding image-formed sheet. When the preceding image-formed sheet is conveyed into the sheet discharge processing device 5, the switching gate 52 causes the sheet to be conveyed into the switchback convey path on the side where the convey abnormality has occurred. When this operation is completed, the switching gate 52 is switched to perform discharge processing of the conveyed sheet. When this discharge processing is completed, the next image-formed sheet is conveyed into the switchback convey path having undergone discharge processing at the same time when discharge processing of the preceding sheet set in a standby state in the other switchback convey path is performed.

When a convey abnormality of the preceding sheet is detected, the next image-formed sheet is completely conveyed into the other switchback convey path, and a sheet having undergone image formation corresponding to the convey abnormality can be discharged before the succeeding sheet in the above manner. With this operation, sheets can be collated.

If a convey abnormality occurs during conveyance of the succeeding sheet into one switchback convey path, the preceding sheet can be discharged without upsetting the page order. If, however, a convey abnormality occurs during conveyance of the preceding sheet, the paper order is upset, as described above. This is because when the preceding sheet is removed, the succeeding sheet skips the preceding sheet. In the conventional device having one switchback convey path, the succeeding image-formed sheet having no error is wasted, and images are sequentially formed from the preceding sheet in trouble, thereby performing discharge processing without upsetting the page order. According to the present invention, however, discharge processing can be performed, after an image corresponding to the preceding sheet having a trouble is formed, without causing such inconveniences, without wasting the preceding sheet not having a trouble, in particular.

In this case, if a sheet to be discharged from the switchback convey path is detected by the detection sensor 57 or 60 after the lapse of a predetermined period of time, a sheet convey abnormality is detected. In this manner, a convey abnormality can be easily detected. For this detection, a known conventional jam detection technique may be used. Although not shown, a third detection sensor may be placed midway along the convey path to the curl removing rollers 64, as described above. The time interval between the instant at which a sheet discharge operation is started and the instant at which the leading end of the sheet is detected by the third detection sensor is constant. That is, a convey abnormality can be detected if the leading end of the sheet is not detected after the lapse of this constant time.

The above control operations based on reverse discharge processing in the present invention will be summarized below. First of all, in performing switching control of the switching gate 52, a switching operation is reliably performed while the trailing end of a sheet in the convey direction is absent in the reverse guide path of the switching gate 52. This switching control is performed by checking the presence of a sheet in one switchback convey path at the timing when conveyance of a sheet into the other switchback convey path is detected. In this case, switching control can be performed after the lapse of a time of a timer set on the basis of the size of the preceding sheet upon completion of conveyance.

When a convey abnormality of the preceding sheet to be discharged is detected, the convey operation for the sheet is stopped, and conveyance of the succeeding sheet is completed. When the sheet having a convey abnormality is removed, the switching gate 52 can be switched without posing any problem. In addition, the page order of discharge sheets is not upset, and the succeeding sheet is not wasted.

In the above description, the present invention is applied to the digital copying machine. However, the present invention can also be applied to a general copying machine other than such an image forming apparatus. The present invention can be applied to a copying machine having only a general copying machine function, in particular, by manually switching the mode of reversing/conveying sheets, and the mode of conveying sheets without reversing them. Assume that a copying machine has an automatic document feeder. In this case, if a copy operation is started from the uppermost or lowermost portion of an original, an image-formed sheet is preferably discharged without being reversed or after being reversed. In this case as well, the sheet discharge processing device of the present invention can be used without any modification.

As has been described above, according to the sheet discharge processing device of the present invention, even if the sheet convey cycle on the image forming apparatus side is decreased, reverse discharge processing of sheets can be performed in the corresponding cycle. Since the paths of the switching gate for reverse discharge processing can be reliably switched to the respective switchback convey paths, in particular, a sheet guide failure and a convey failure can be prevented. In addition, sheets can be reliably guided to the respective switchback convey paths through the reverse guide paths of the switching gate regardless of the curls and the like of the sheets. Furthermore, sheets can be reliably guided from the switchback convey paths to the discharge paths.

In addition, since a part of each switchback convey path is formed into a loop, the wasteful space in the sheet discharge processing device can be reduced, and a reduction in size can be attained. In this case, even if a loop-like guide member is formed only on the outside, the frictional resistance and the like between the sheet and the guide members can be reduced, and hence the sheet can be reliably guided into the loop-like guide portion without causing a sheet convey failure. Furthermore, sheets can be discharged onto the discharge tray in the same curling state so that the discharged sheets are reliably stacked on each other without upsetting the page order.

In performing sheet discharge processing control, switching control is not performed with the trailing end of a sheet being left in any one of the guide paths of the switching gate, but switching control can be reliably performed at the timing when the trailing end of the sheet reliably passes through the switching gate. This control prevents damage to the trailing end of a sheet and the switching gate.

Even if sheets having different sizes are to be processed, switching control of the above switching gate can be performed without posing any problem. Since the size of a sheet to be processed can be detected on the sheet discharge processing device side, in particular, the switching gate can be controlled in accordance with sheet discharge processing suitable for the detected size. With this control, sheet discharge processing can be performed more efficiently.

In addition, if a convey abnormality of the preceding sheet is detected, the succeeding sheet can be completely conveyed into one switchback convey path and set in a standby state, and discharge control for the preceding sheet can be performed first upon covering the damaged sheet. Therefore, sheets can be discharged without upsetting the page order, and no wasteful image-formed sheet is produced.

What is claimed is:

1. A sheet discharge processing device for sequentially discharging sheets, sent through image forming means for forming images on the sheets on the basis of image data, onto a discharge tray with image-bearing surfaces of the sheets facing up or down, comprising:

first and second switchback convey paths being vertically arranged between an inlet path into which a sheet conveyed through said image forming means is conveyed and a discharge path for discharging a sheet onto the discharge tray, and said first and second switchback convey paths being adapted to reverse the front and back of sheets;

a switching gate including a first reverse guide path for causing said first switchback convey path to communicate with the discharge path when said second switchback convey path communicates with said inlet path, a second reverse guide path for causing said second switchback convey path to communicate with the discharge path when said first switchback convey path communicates with said inlet path, and a straight guide path for causing said inlet path to communicate with the discharge path, and said switching gate being rotatably placed between said inlet path and the discharge path;

first and second storing sections arranged at an upper end portion of said first switchback convey path and a lower end portion of said second switchback convey path to store sheets conveyed through said first and second switchback convey paths; and loop-like guide members, storing sheets conveyed from said first and second switchback convey paths into said first and second storing sections therein, respectively arranged in said first and second storing sections so as to smoothly convey the sheets;

wherein said guide members are arranged in said first and second storing sections to guide only substantially central portions of sheets, which is a direction perpendicular to the sheets relative to the paths of the sheets, conveyed from said first and second switchback convey paths into said first and second storing sections.

2. The sheet discharge processing device according to claim 1, wherein each of said loop-like guide members arranged in said first and second storing sections has an inner diameter not less than 50 mm and not more than a diameter of a maximum-size circle formed by a maximum-size sheet processed by said image forming means.

3. The sheet discharge processing device according to claim 1, wherein said guide members are formed such that widths thereof gradually decrease in directions to guide sheets to be conveyed from said first and second switchback convey paths into said first and second storing sections.

4. The sheet discharge processing device according to claim 1, wherein said first and second storing sections are arranged in said processing device such that sheets conveyed from said respective storing sections to said discharge path through said first and second switchback convey paths curl in the same direction.

5. The sheet discharge processing device according to claim 1, wherein said guide member has a loop formed such that an angle defined by an extended line of a leading end of a sheet guided to a terminal end portion of said guide member and a tangent at an intersection between the extended line and said guide member is not more than 30°.

6. A sheet discharge processing device for sequentially discharging sheets, sent through image forming means for forming images on the sheets on the basis of image data, onto a discharge tray with image-bearing surfaces of the sheets facing up or down, comprising:

first and second switchback convey paths being vertically arranged between an inlet path into which a sheet conveyed through said image forming means is conveyed and a discharge path for discharging a sheet onto the discharge tray, and said first and second switchback convey paths being adapted to reverse the front and back of sheets;

a switching gate including a first reverse guide path for causing said first switchback convey path to communicate with the discharge path when said second switchback convey path communicates with said inlet path, a second reverse guide path for causing said second switchback convey path to communicate with the discharge path when said first switchback convey path communicates with said inlet path, and a straight guide path for causing said inlet path to communicate with the discharge path, and said switching gate being rotatably placed between said inlet path and the discharge path;

first and second storing sections arranged at an upper end portion of said first switchback convey path and a lower end portion of said second switchback convey path to store sheets conveyed through said first and second switchback convey paths; and loop-like guide members, storing sheets conveyed from said first and second switchback convey paths into said first and second storing sections therein, respectively arranged in said first and second storing sections so as to smoothly convey the sheets;

wherein each of said guide members comprises: a loop-like main guide member for guiding only substantially central portions of sheets conveyed from said first and second storing switchback convey paths into said first and second storing sections; and loop-like auxiliary guide members arranged to be substantially symmetrical about said main guide member so as to guide only two side end portions of the sheet, and said auxiliary guide member has an inner diameter larger than an inner diameter of said main guide member.

7. A sheet discharge processing device for sequentially discharging sheets, sent through image forming means for forming images on the sheets on the basis of image data, onto a discharge tray with image-bearing surfaces of the sheets facing up or down, comprising:

first and second switchback convey paths being vertically arranged between an inlet path into which a sheet conveyed through said image forming means is conveyed and a discharge path for discharging a sheet onto the discharge tray, and said first and second switchback convey paths being adapted to reverse the front and back of sheets;

a switching gate including a first reverse guide path for causing said first switchback convey path to communicate with the discharge path when said second switchback convey path communicates with said inlet path, a second reverse guide path for causing said second switchback convey path to communicate with the discharge path when said first switchback convey path communicates with said inlet path, and a straight guide path for causing said inlet path to communicate with the discharge path, and said switching gate being rotatable placed between said inlet path and the discharge path;

first and second storing sections arranged at an upper end portion of said first switchback convey path and a lower end portion of said second switchback convey path to store sheets conveyed through said first and second switchback convey paths; and loop-like guide members, storing sheets conveyed from said first and second switchback convey paths into said first and second storing sections therein, respectively arranged in said first and second storing sections so as to smoothly convey the sheets;

wherein said guide members are divided into a plurality of members and are formed such that the number of the plural guide members decreases in a direction in which sheets are conveyed from said first and second switchback convey paths into said first and second storing sections.

8. A sheet discharge processing device for sequentially discharging sheets, sent through image forming means for forming images on the sheets on the basis of image data, onto a discharge tray with image-bearing surfaces of the sheets facing up or down, comprising:

first and second switchback convey paths being vertically arranged between an inlet path into which a sheet conveyed through said image forming means is conveyed and a discharge path for discharging a sheet onto the discharge tray, and said first and second switchback convey paths being adapted to reverse the front and back of sheets;

a switching gate including a first reverse guide path for causing said first switchback convey path to communicate with the discharge path when said second switchback convey path communicates with said inlet path, a second reverse guide path for causing said second switchback convey path to communicate with the discharge path when said first switchback convey path communicates with said inlet path, and a straight guide path for causing said inlet path to communicate with the discharge path, and said switching gate being rotatably placed between said inlet path and the discharge path;

first and second convey rollers being respectively arranged on said first and second switchback convey paths, and said first and second convey rollers being able to be rotated in forward and reverse directions;

first and second detection sensors being arranged between said first and second convey rollers and said switching gate to detect sheets conveyed into said first and second switchback convey paths; and control means for controlling rotation of said first and second convey rollers, and controlling a rotation position of said switching gate to reverse and discharge a sheet through said first or second switchback convey path when a trailing end of the sheet conveyed into one of said first and second switchback convey paths is detected by said first or second detection sensor, and discharge processing of a sheet in the other switchback convey path, which is different from said switchback convey path in which the trailing end of the sheet has been detected, is completed.

9. The sheet discharge processing device according to claim 8, wherein said control means controls a rotation position of said switching gate a predetermined period of time after completion of conveyance of a sheet into one of said switchback convey paths is detected by said first or second detection sensor, and completion of discharge processing of a sheet from the other switchback convey path is detected by said second or first detection sensor.

10. The sheet discharge processing device according to claim 9, wherein when an abnormality occurs in conveyance of a preceding sheet discharged through one of said switchback convey paths, said control means controls a rotation position of said switching gate to discharge a sheet on which an image identical to an image formed on the preceding sheet having the abnormality in conveyance is formed ahead of a succeeding sheet after said control means stops a convey operation in the one of said switchback convey paths and stops a convey operation in the other switchback convey path at the same time when the succeeding sheet is completely conveyed into the other switchback convey path, and the preceding sheet having the abnormality is removed.

11. A sheet discharge processing device for sequentially discharging sheets, sent through image forming means for forming images on the sheets on the basis of image data, onto a discharge tray with image-bearing surfaces of the sheets facing up or down, comprising:

first and second switchback convey paths being vertically arranged between an inlet path into which a sheet conveyed through said image forming means is conveyed and a discharge path for discharging a sheet onto the discharge tray, and said first and second switchback convey paths being adapted to reverse the front and back of sheets;

a switching gate including a first reverse guide path for causing said first switchback convey path to communicate with the discharge path when said second switchback convey path communicates with said inlet path, a second reverse guide path for causing said second switchback convey path to communicate with the discharge path when said first switchback convey path communicates with said inlet path, and a straight guide path for causing said inlet path to communicate with the discharge path, and said switching gate being rotatably placed between said inlet path and the discharge path;

first and second convey rollers being respectively arranged on said first and second switchback convey paths, and said first and second convey rollers being able to be rotated in forward and reverse directions;

first and second detection sensors being arranged between said first and second convey rollers and said switching gate to detect sheets conveyed into said first and second switchback convey paths;

timer means in which a time taken for a trailing end of a sheet discharged from said first or second switchback convey path to pass completely through one of the reverse guide paths of said switching gate is set in advance, and said timer means starting to count the set time in response to starting a discharge operation for a sheet; and control means for controlling rotation of said first and second convey rollers, and controlling a rotation position of said switching gate to reverse and discharge a sheet through said first or second switchback convey path after a trailing end of the sheet conveyed into one of said first and second switchback convey paths is detected by said first or second detection sensor, and it is determined that said timer means has completely counted the set time.

12. The sheet discharge processing device according to claim 11, wherein the time set in said timer means in advance is determined in accordance with a size of a sheet conveyed into said first or second switchback convey path.

13. The sheet discharge processing device according to claim 11, wherein the time set in said timer means in advance is a time obtained by starting a time counting operation when a leading end of a sheet conveyed into said first or second switchback convey path is detected by said first or second detection sensor, and stopping the time counting operation when a trailing end of the sheet is detected by said first or second detection sensor.

* * * * *